US008894480B2

(12) United States Patent
Johnson et al.

(10) Patent No.: US 8,894,480 B2
(45) **Date of Patent: *Nov. 25, 2014**

(54) TOURNAMENT GAME, GAMING MACHINE, GAMING SYSTEM AND METHOD WITH A PLAYER-INTERACTIVE BONUS FEATURE

(71) Applicant: Multimedia Games, Inc., Austin, TX (US)

(72) Inventors: Bradley W. Johnson, Austin, TX (US); John J. Carpenter, Austin, TX (US); JP Cody, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 120 days.

This patent is subject to a terminal disclaimer.

(21) Appl. No.: 13/624,486

(22) Filed: Sep. 21, 2012

(65) Prior Publication Data

US 2013/0065659 A1 Mar. 14, 2013

Related U.S. Application Data

(63) Continuation-in-part of application No. 13/240,920, filed on Sep. 22, 2011, now Pat. No. 8,419,520.

(60) Provisional application No. 61/541,903, filed on Sep. 30, 2011, provisional application No. 61/388,598, filed on Sep. 30, 2010, provisional application No. 61/406,019, filed on Oct. 22, 2010.

(51) Int. Cl.
*G07F 17/32* (2006.01)

(52) U.S. Cl.
USPC ..... 463/16; 463/20; 463/25; 463/29

(58) Field of Classification Search
USPC ..... 463/16, 20, 25, 29
See application file for complete search history.

(56) References Cited

U.S. PATENT DOCUMENTS

| | | | | |
|---|---|---|---|---|
| 5,816,918 | A * | 10/1998 | Kelly et al. | 463/16 |
| 6,626,758 | B1 | 9/2003 | Parham et al. | |
| 7,575,517 | B2 | 8/2009 | Parham et al. | |
| 7,811,168 | B2 | 10/2010 | Parham et al. | |
| 7,871,328 | B2 | 1/2011 | Parham et al. | |
| 7,887,415 | B2 | 2/2011 | Parham et al. | |
| 8,419,520 | B2 * | 4/2013 | Johnson | 463/16 |
| 2003/0114218 | A1 | 6/2003 | McClintic | |
| 2006/0079319 | A1 | 4/2006 | Aoki et al. | |
| 2006/0277100 | A1 | 12/2006 | Parham | |

(Continued)

OTHER PUBLICATIONS

International Search Report dated Feb. 22, 2012, in PCT application No. PCT/US2011/53191 (2 pages).

(Continued)

*Primary Examiner* — Omkar Deodhar
(74) *Attorney, Agent, or Firm* — Nathan H. Calvert, Esq.; Russell D. Culberston, Esq.; JP Cody, Esq.

(57) ABSTRACT

A tournament game, gaming machine, gaming system and method are disclosed wherein a player-interactive bonus feature is triggered and displayed simultaneously with a tournament game presentation and a bonus award is paid responsive to a player selecting a displayed bonus target, such as a balloon. The bonus award is paid in addition to any award payable based on the tournament game outcome. The award may be non-credit prizes redeemed in various ways such as printing a coupon at the player machine.

20 Claims, 13 Drawing Sheets

(56) References Cited

U.S. PATENT DOCUMENTS

| | | | |
|---|---|---|---|
| 2008/0102916 | A1 | 5/2008 | Kovacs et al. |
| 2009/0189351 | A1 | 7/2009 | Baerlocher et al. |
| 2009/0197674 | A1 | 8/2009 | Parham et al. |
| 2010/0004058 | A1 | 1/2010 | Acres |
| 2010/0035674 | A1 | 2/2010 | Slomiany et al. |
| 2011/0130196 | A1 | 6/2011 | Parham et al. |

OTHER PUBLICATIONS

Written Opinion of the International Search Authority dated Feb. 22, 2012, in PCT application No. PCT/US2011/53191 (4 pages).

* cited by examiner

TOURNAMENT GAME, GAMING MACHINE, GAMING SYSTEM AND METHOD WITH A PLAYER-INTERACTIVE BONUS FEATURE

CROSS-REFERENCE TO RELATED APPLICATIONS

The Applicants claim the benefit, under 35 U.S.C. §119(e), of U.S. Provisional App. No. 61/541,903 filed Sep. 30, 2011, and entitled "Tournament Game, Gaming Machine, Gaming System and Method With A Player-Interactive Bonus Feature." The Applicants also claim the benefit, under 35 U.S.C. §120, of U.S. patent application Ser. No. 13/240,920 filed Sep. 22, 2011, and entitled "Tournament Game, Gaming Machine, Gaming System and Method With A Player-Interactive Bonus Feature," which claims the benefit of and incorporates by reference U.S. Provisional Apps. Nos. 61/388,598 and 61/406,019, respectively filed Sep. 30, 2010 and Oct. 22, 2010, of the same title. The Applicants hereby claim the benefit of each of these prior U.S. provisional and nonprovisional patent applications. The entire content of each of these prior U.S. provisional and nonprovisional patent applications is incorporated herein by this reference.

COPYRIGHT NOTICE

A portion of the disclosure of this patent document contains material which is subject to copyright protection. The copyright owner has no objection to the facsimile reproduction of the patent document or the patent disclosure as it appears in the U.S. Patent and Trademark Office patent files or records but otherwise reserves all rights of copyright whatsoever.

FIELD OF THE INVENTION

This invention relates to wagering games, gaming machines, gaming systems, and associated methods. More particularly, the invention relates to convertible in-revenue and out-of-revenue gaming machines, systems and related methods which provide an interactive bonus feature for the players.

BACKGROUND

Various gaming systems have been developed to provide in-revenue and out-of-revenue gaming. Most of those systems are either dedicated to in-revenue operation or out-of-revenue operation. An example of in-revenue operation is a gaming machine or system in which game play is initiated with a money (or equivalent) wager by a player. An example of out-of-revenue operation is a gaming machine or system in which game play doesn't require a wager (e.g. tournament or free play).

There continues to be a need for innovative methods and gaming systems which provide convertibility between in-revenue and out-of-revenue gaming operations. There is also a need for innovative methods and systems for presenting tournament games in different ways to generate player interest and excitement.

SUMMARY OF THE INVENTION

In accordance with one or more embodiments of the present invention, a tournament game includes a tournament game presentation in accordance with a random or pseudo-randomly determined tournament game outcome and a player-interactive bonus feature triggered and displayed simultaneously with the tournament game presentation. A bonus award is awarded responsive to a player selecting a displayed bonus target, such as a balloon. The bonus award may be awarded in addition to any award payable based on the tournament game outcome.

In other embodiments, the system may give away actual prizes (that is, non-credit prizes) when the player selects a bonus target in the tournament. In the case of non-credit prizes, instead of winning tournament points when the player pops a balloon, the players will win actual prizes. This feature may be used for out of revenue slot tournament games and also for standard in-revenue slot games or any other electronic casino game.

These and other advantages and features of the invention will be apparent from the following description of illustrative embodiments, considered along with the accompanying drawings.

DESCRIPTION OF ILLUSTRATIVE EMBODIMENTS

Figure 1:
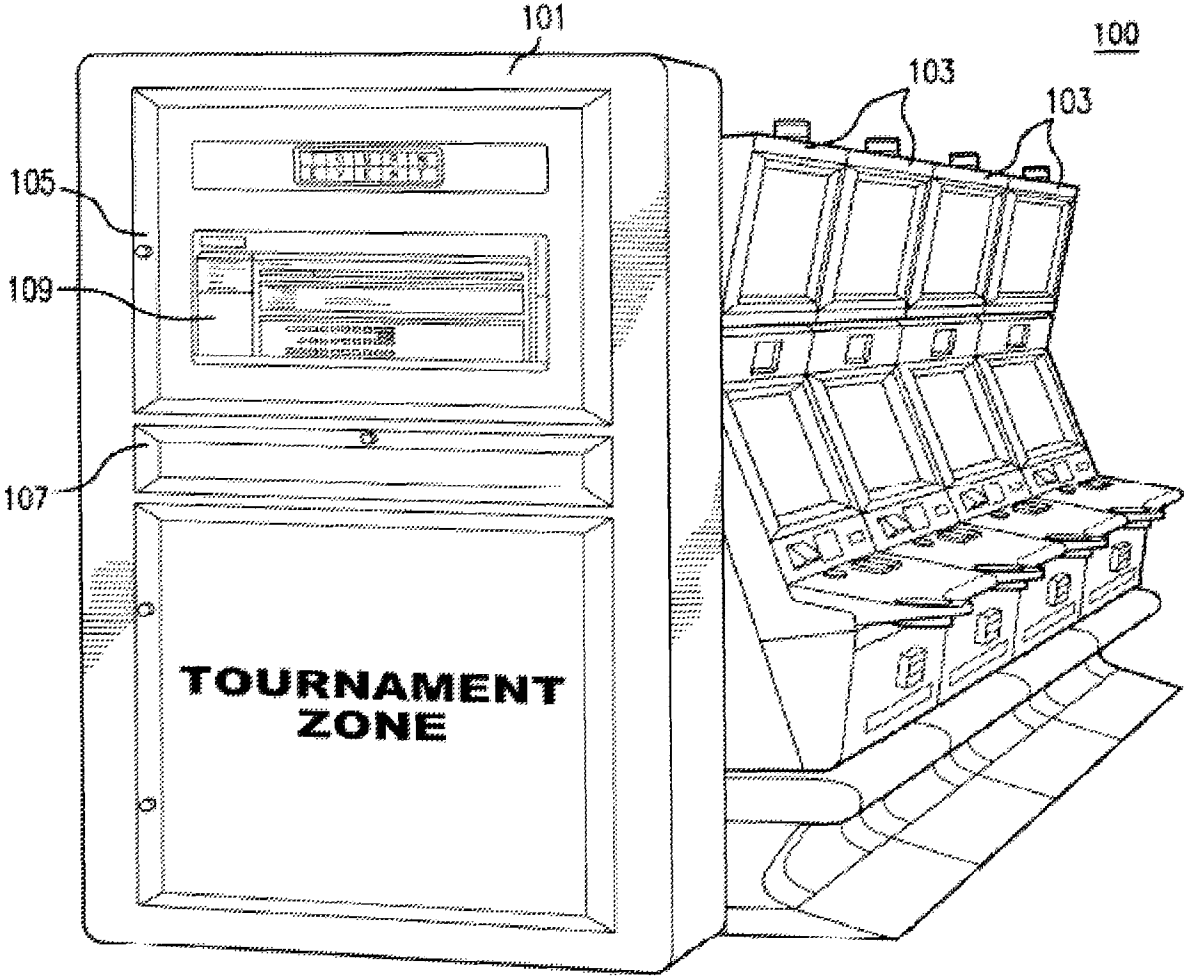
FIG. 1 illustrates an example convertible in-revenue and out-of-revenue gaming system shown with a control center server controlling a bank of gaming machines with respective game themes, such as during an in-revenue gaming operating mode, in accordance with one or more embodiments.

Referring to FIG. 1 and also to FIGS. 2-7, example server-based convertible in-revenue and out-of-revenue gaming system 100 is shown with control center server 101 enabling remote functionality management of a number of gaming machines 103, such as updating game configuration, uploading advertisements, administering tournaments, and converting in-revenue and out-of-revenue operation, in accordance with one or more embodiments. Control center server 101 includes a user console secured by key-locked cabinet doors 105 and 107. The user console includes display 109 and a conventional keyboard and mouse (not shown). Display 109 is visible through a window of door 105. Door 107 opens about a horizontally disposed hinge or hinges situated at the lower portion of the door so that it may swing downward. Behind door 107 a recessed slideable tray may support the keyboard and mouse and slide outward approximately six to eight inches to accommodate user (such as a casino operator) access to the keyboard and mouse. The keyboard, mouse, and display 109 connect to the server which may be a conventional personal computer motherboard or server grade hardware with ports to support the peripherals along with network connections and memory, such as a hard drive, PROM or CD ROM, containing the programming to support the server controlling in-revenue and out-of-revenue operating modes of gaming machines 103 and to support creation, editing, and storing of command, instruction, and data sets associated with in-revenue and/or out-of-revenue events. The installed software may include a Microsoft Windows® OS enabling menu driven document creation and editing to provide user-friendly document/program search or creation, editing, storage, and execution functionality within the limits of the user's authorization level. User authorization and access may be accommodated through an initial username and password entry screen. Once a user's authorization has been verified through matching with records stored on the server or network, a main menu may be displayed enabling a user to access, initiate or program out-of-revenue or in-revenue events.

As will be discussed further below, control center server 101 may be programmed to implement several different controllers providing functions or services for the gaming machines 103 and associated equipment (such as the overhead display 111 described below). In particular, control center server 101 may implement a tournament controller for controlling and facilitating the conversion of gaming machines 103 from individual in-revenue play to tournament play (either in-revenue or out-of-revenue) and back. During tournament play, the tournament controller communicates with the various gaming machines 103 participating in the tournament, maintains information on the conduct of the tournament, such as real-time standings and scores, and makes tournament information available to the gaming machines 103 or other system elements for display over the course of the tournament. In its operation as a tournament controller, control center server 101 also controls the conversion of gaming machines 103 back from tournament play mode to individual play mode.

During in-revenue operational mode (such as shown for example in FIGS. 1-3), gaming machine 103 may operate conventionally wherein a player may: a) enter currency, such as through bill acceptor 403, b) initiate a wager by selecting one or more lines and one or more credits per line, such as by respectively pressing the lines and credits buttons on button deck 405, and c) initiate play of the game displayed on display 115 by pressing the play, repeat bet, or max bet button on button deck 405. In-revenue operation may be performed through Class II or Class III gaming machines.

Class II gaming machines include bingo-based, lottery and/or central determination gaming machines; for example, a player may initiate a game at a Class II gaming machine, a processor for the gaming machine may send a request for a game outcome which may be transmitted to the gaming machine from an external server (e.g. central determination server) based on a random determination, and a game presentation may be displayed by the gaming machine in accordance with the game outcome. Often Class II gaming systems include a network of connected gaming machines (player stations) and use a finite pool of outcomes wherein the pool of possible outcomes are reduced by one each time an outcome is selected from the pool.

Class III gaming machines may include a random or pseudo-random number generator operated by a processor which may be local or remote to the gaming machine. The processor may determine a game outcome using the random number generator and the gaming machine may display a game presentation in accordance with the determined game outcome.

In either Class II or III gaming machines or systems, the player may be paid an award by the gaming machine or gaming system in accordance with the determined game outcome and a paytable which may be stored on the gaming machine or may be accessible by the gaming machine.

Conversion of a selected set of gaming machines 103 connected to control center server 101 may be programmed to occur at one or more selected times during any period of time, e.g. a day, week, month, as may be elected by a user (operator). In accordance with programming as tournament controller, control center server 101 may transmit instructions to the selected set of gaming machines 103 concerning an impending conversion and subsequently to initiate a conversion from in-revenue operating mode for individual play to a competition operating mode for group play. The programming may be initiated automatically according to a schedule or may be initiated manually by a user. In one or more embodiments, control center server 101 may be programmed to transmit an impending conversion instruction or instructions to the selected set of gaming machines a selected period of time or times prior to the conversion, such as 15, 10, 5, and/or 1 minute. For example, control center server 101 may instruct each gaming machine 103 to display a fifteen minute warning, ten minute warning, five minute warning, and then display a sixty second countdown. Control center server 101 may further instruct each gaming machine 103 to disable additional in-revenue play following the completion of the countdown and following completion of any current game play to automatically cash out the credit meter of any associated gaming machine 103. Following cash out, control center server 101 functioning as tournament controller may transmit instructions to each of gaming machines 103 to display respectively associated players' names and to install the competition game for the group play session being initiated.

One example of an out-of-revenue operational mode may be a tournament event (such as shown for example in FIGS. 6-7) wherein a game having the same paytable and volatility is installed and operational on each of gaming machines 103. During a tournament event, each participating gaming machine 103 may be operated without funds, players may accumulate virtual points or dollars by playing a game on their respective gaming machine 103, and one or more winners may be identified based on the accumulated totals obtained during a predetermined period of time, which may correspond to a programmed or manually initiated definitive start and stop time or a predetermined number of plays. For example, an operator may initiate a tournament event by using a menu program with the console connected to control center server 101 and selecting the participating gaming machines, an amount of time for the tournament to play, and a begin tournament option. Alternatively, the predetermined period of time may comprise randomly triggered start and/or stop times, such as through a game event or through use of a random number generator. During the tournament event, each participating gaming machine may capture live streaming video of tournament contestants through respective cameras 401 (shown in FIG. 4A and FIG. 5) and transfer the live video feed in accordance with programming to selected locations, such as overhead display 111 (FIG. 6 and others) or player dashboard 2803 (FIG. 8). Throughout the tournament event, leader board 601 shown in FIGS. 6 and 7 may be displayed on a real-time basis to present tournament standings and live video feed 603 may be displayed to present player reactions on overhead display 111. During tournaments, the player's video may be displayed for a certain amount of time along with their current position. The video feed may then be switched so that overhead display 111 shows live video of another player participating in the tournament. In one implementation, video of all players in the tournament, or some subset such as the top five players, may be serially displayed on overhead display 111. That is, video of the first place player is displayed for a time, then switched to the second place player, then the third place player and so forth, returning to video of the first place player upon completion of showing all or the designated subset of players. Also, some implementations may cause the video displayed at overhead display 111 to be switched when there is a change in rankings of the players in a tournament. For example, the video displayed at overhead display 111 may be switched to live video of the new first place player when a lower ranking player overtakes the leader to become the new first place player. At the completion of a tournament, the winner's video may be shown on overhead signs with a celebratory message. In one or more instances, a player may opt for anonymity while playing. In one or more embodiments, the player may select a player avatar from a set of available avatars and/or a pseudonym which may be displayed in place of a live video feed of the player.

Figure 2:
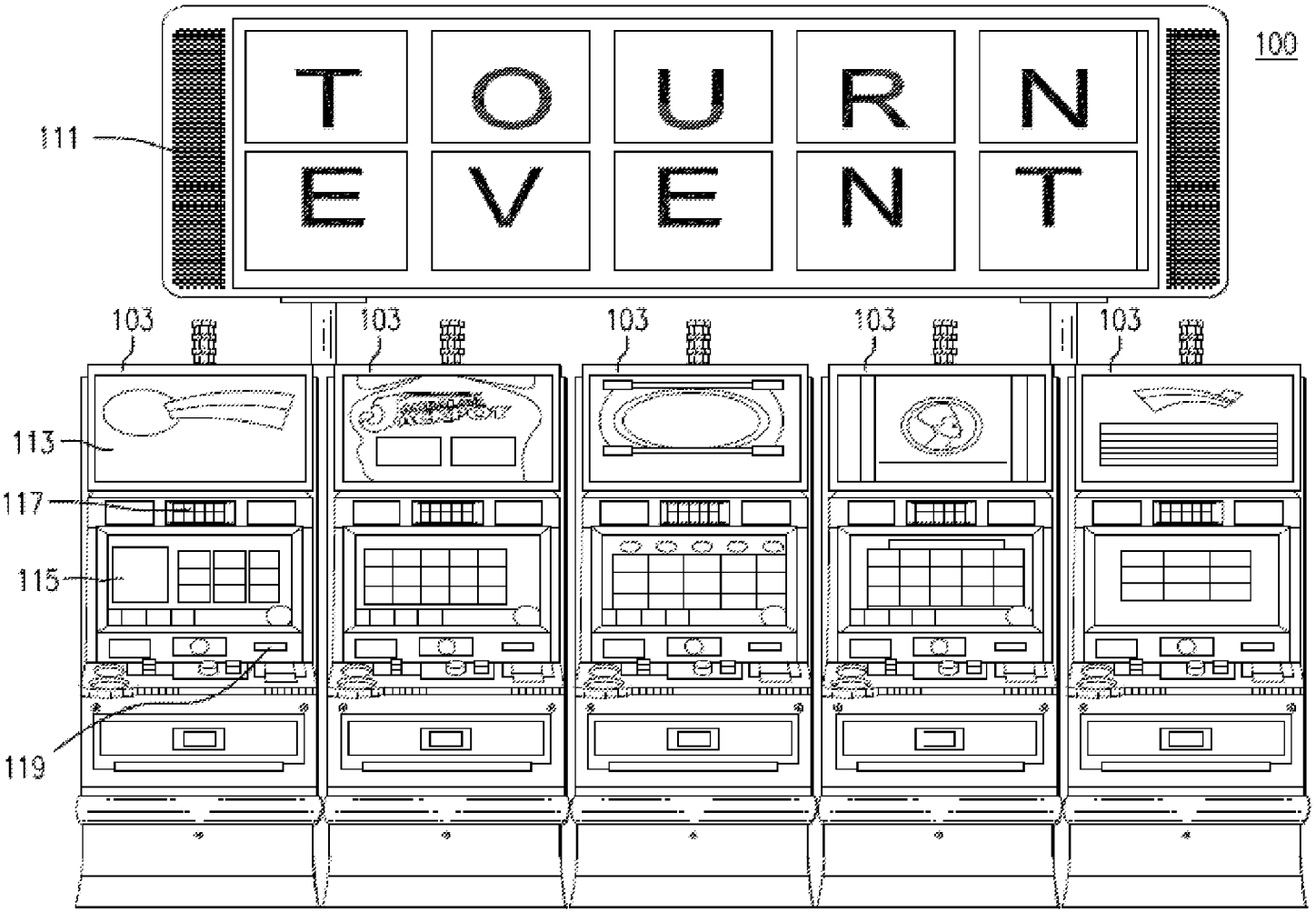
FIG. 2 illustrates an example convertible in-revenue and out-of-revenue gaming system with a bank of gaming machines with respective game themes, such as during an in-revenue gaming operating mode, and a connected overhead display showing an example tournament advertising banner TOURNEVENT® in accordance with one or more embodiments.

Referring to FIG. 2, another embodiment of convertible in-revenue and out-of-revenue gaming system 100 is shown with a bank of gaming machines 103 with respective game themes, such as during an in-revenue gaming operating mode, and connected to overhead display 111 (showing an example tournament advertising banner) in accordance with one or more embodiments. Each of gaming machines 103 and overhead display 111 may be conventionally networked to coordinate gaming events and conversion between in-revenue and out-of-revenue operating modes. A networked conversion and controller unit may be an external server, such as control center server 101, a remote floor server, or a remote backend server, or, one of gaming machines 103 may be programmed to operate as a control center server. As shown by example in FIG. 2, gaming machines 103 may be configured in-revenue and have various games being presented or offered, such as Multimedia Games' Ringy Dingy Reels®, Jambalaya Jackpot®, Meltdown®, Queen of the Desert®, and Texas Tornado®, with respective paytables and volatilities.

In the case where one of gaming machines 103 may operate as the control center server, the screenshot examples shown herein (e.g. FIG. 8 et seq.) may be displayed on one of the displays, such as display 113 or 115, each of which or either may be implemented as touch screen displays. In order to access the control center server operability, a user (operator) may be required to insert an authorized user card in card reader 119 and enter a password such as may be prompted on display 117. Upon identification of an authorized user, gaming machine 103 may display a menu on display 113 providing options for initiating or programming in-revenue or out-of-revenue operating modes and may further display a virtual keyboard on display 115 which may be used to enter data into respective fields shown on display 113. Additionally, in the case where one of gaming machines 103 may operate as the convertible server, all or a portion of gaming machines 103 may store the applicable programming so that in the event that an initially designated master gaming machine becomes inoperable, one of the other gaming machines 103 may, either automatically according to a designated priority or manually, be designated to assume the control center server operations.

Figure 3B:
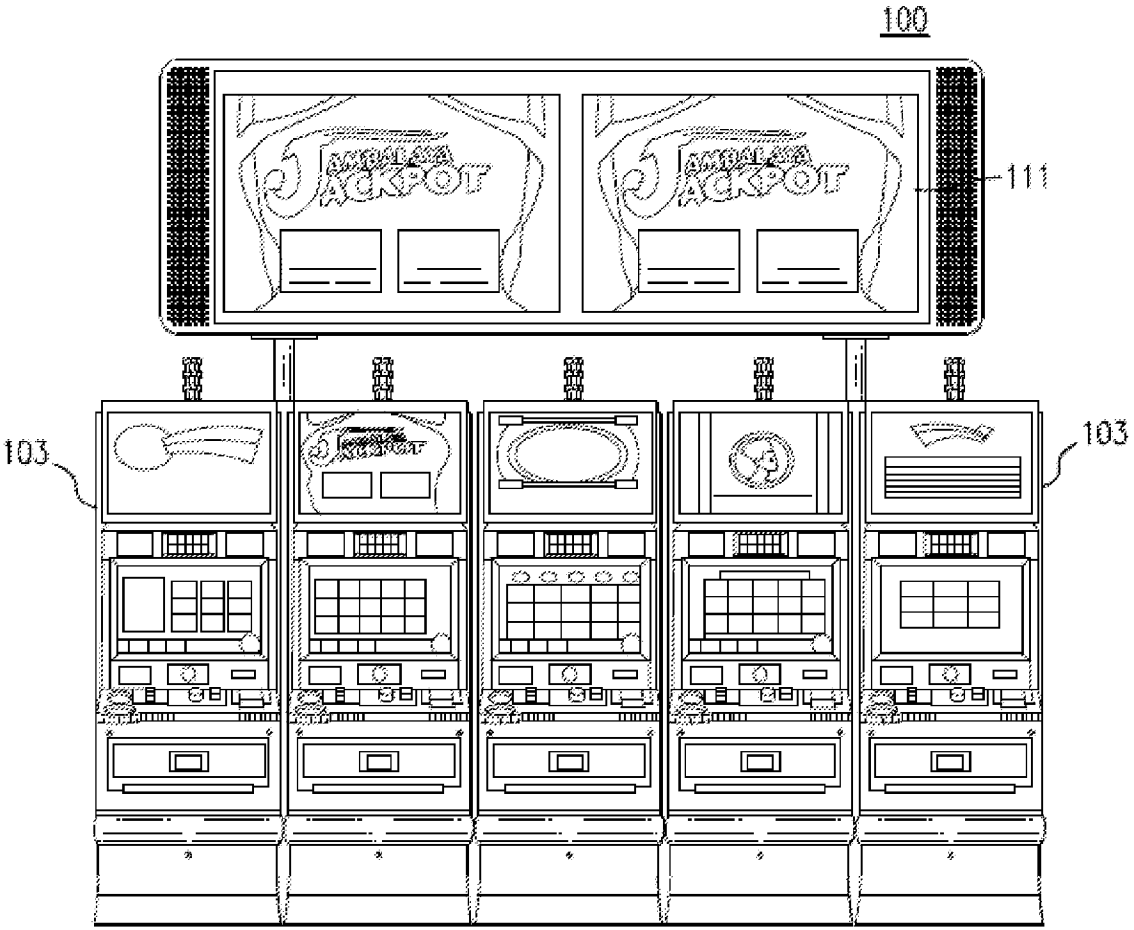
FIG. 3B is a front view of an example convertible in-revenue and out-of-revenue gaming system shown in FIG. 3A with the overhead display showing an example game theme advertising banner JAMBALAYA JACKPOT® in accordance with one or more embodiments.
Figure 3A:
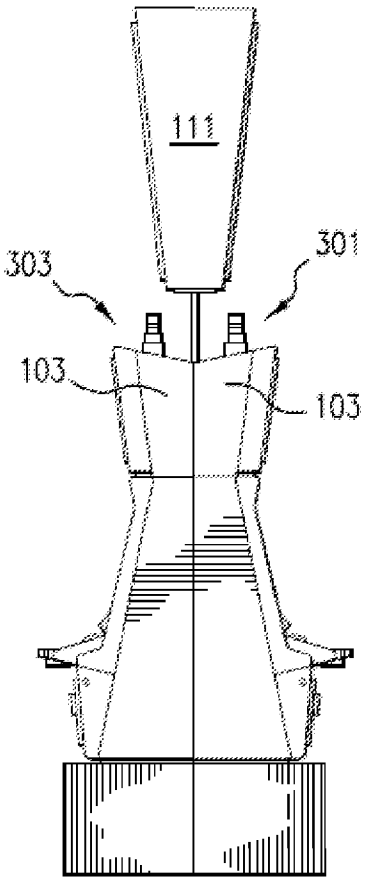
FIG. 3A is a side view of an example convertible in-revenue and out-of-revenue gaming system with two back-to-back banks of gaming machines with respective game themes, such as during an in-revenue gaming operating mode, and a connected overhead display in accordance with one or more embodiments.

Referring to FIGS. 3A and 3B, a side and front view, respectively, of an example implementation of convertible in-revenue and out-of-revenue gaming system 100 is shown with two back-to-back sets 301, 303 of gaming machines 103 (which may be referred to as a bank or a pair of banks) with respective game themes, such as during an in-revenue gaming operating mode, and connected to a pair of back-to-back overhead displays 111 (showing an example game theme advertising banner) in accordance with one or more embodiments. As shown in FIG. 3A, pairs of back-to-back overhead displays 111 may be installed as a single unit with a casing that may be wider at the top than the bottom and the overhead displays may be slanted to adjust the viewing angle. While the overhead displays 111 may be fixed in relation to the casing, another embodiment may include a swivel attachment of each of display 111 along a horizontal axis enabling adjustment of the viewing angle of each display 111 with relation to the swivel attached to the respective display and the casing. For example, the swivel attachments may be secured to the bottom of the casing and the respective overhead display 111; and, tightening screws may be implemented either together with the swivel attachments or separately to fix the angle of the plane of each overhead display 111.

Figure 4A:
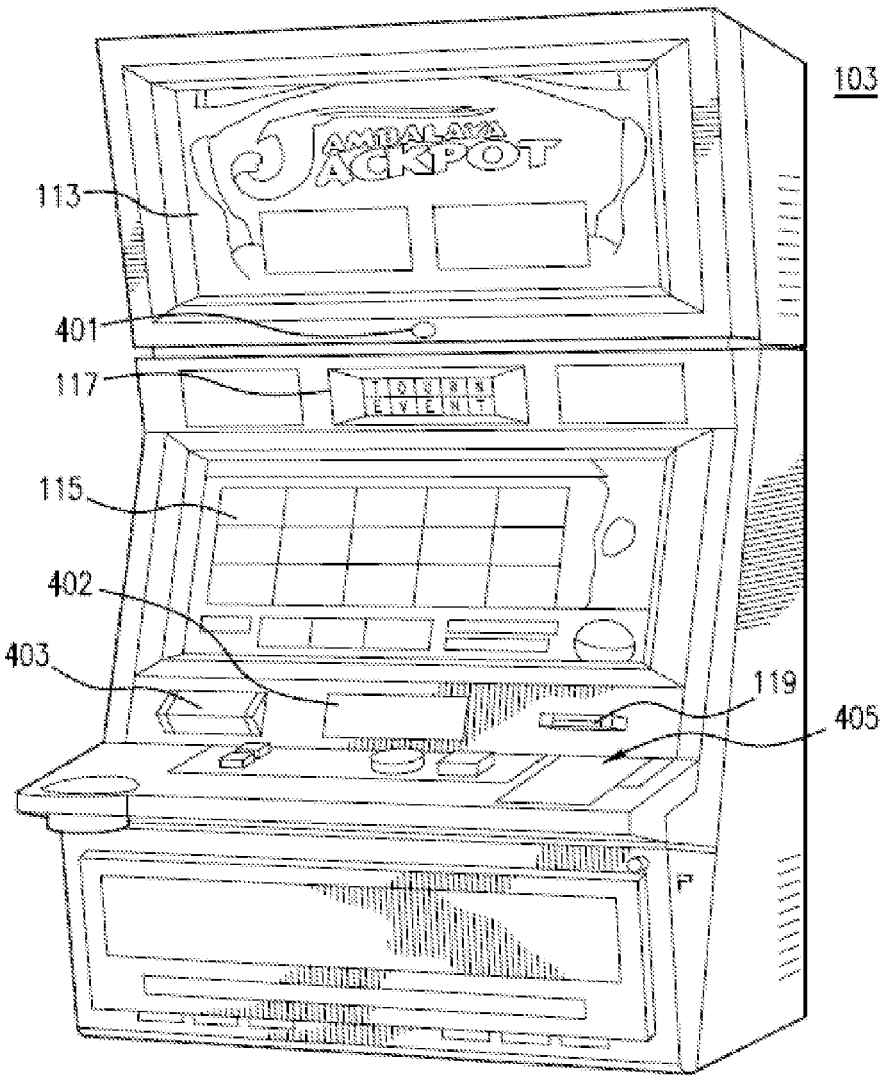
FIG. 4A illustrates an example front view of a convertible gaming machine with a camera and a secondary display with an example tournament advertising banner in accordance with one or more embodiments.

Referring to FIG. 4A, an example front view of convertible gaming machine 103 is shown with embedded camera 401, e.g. a conventional IP-video camera, operable to capture video feed of a player at the gaming machine and transfer the video feed to an area of one of gaming machine displays, such as display 113, 115, or 117, one or more other gaming machines' displays and/or overhead display 111. In the example, display 117 is shown with an example tournament advertising banner in accordance with one or more embodiments.

Referring to FIG. 4A, example gaming machine 103 is shown including top glass display 113, middle display 117, primary display 115, and lower display 402 and user interface 405 (including button deck, printer 403, and card reader 119) wherein an in-revenue or out-of-revenue wagering game may be initiated by a player (such as by pressing the 'Play' button or by making a wager (selecting a number of lines and credits/line) and pressing the 'Play' button), a game processor may obtain a random or pseudo-random game outcome (such as by operating a random number generator (RNG) or by requesting a game outcome from server, e.g. central determination or game, which may use an RNG to make a determination and forward to the game processor). The game processor for gaming machine 103 may instruct one or more displays to display a game presentation (such as spinning the reels in a reel-based game) in accordance with the game outcome, and the processor may pay winning game outcomes by incrementing the credit meter in accordance with the paytable (plus increment any additional amounts in the event of triggering a mystery bonus or other feature bonus).

Top glass display 113 may comprise a programmable portion of or a separate display (such as an LCD, LED, TFT, etc. display) or glass painted, etched, etc. presenting information related to the primary game or theme, such as a display of the paytable associated with the primary game and indicating the awards payable on the various winning primary game outcomes. Display 117 (such as an LCD, LED, TFT, etc. display) may be used to display alternative games (such as a bingo, lottery, card, mini-reel or other wagering game) or other feeds presented through the network, such as advertisements, where the alternative games may or may not require separate wagers or consideration, such as player points accumulated in a player account by a player.

Primary display 115 may display a primary game, such as the displayed Jambalaya Jackpot® reel game, and further display additional information such as lines wagered upon ("Lines"), bet per line ("Bet per Line"), total bet ("Total Bet"), credits on the gaming machine ("Credits"), and any winnings paid following a game play (which may include primary, feature, and community game play) ("Paid"). Display 402 may comprise a portion of display 115 or a separate display (such as an LCD, LED, TFT, etc. display) and display information, such as the player's status, player points, and/or enrollment in any group play (e.g. tournaments or competitions). User interface 405 generally includes a button deck for entering the selected number of lines the player wishes to wager upon, the number of credits per line plus a side bet, and to initiate play of the primary game. User interface 405 may also include card reader 119 for receiving a player card and transmitting player information over a network, and, may include bill acceptor and printer 403 for receiving currency including tickets and printing tickets when a player desires to cash out from the gaming machine.

Referring to FIG. 4A, gaming machine 103, such as a Multimedia Games' Jambalaya Jackpot® gaming machine, is shown, which may by example be connectable as shown in FIGS. 1-3B and have a set of mechanical or video reels displayed by display 115; video camera 401; player interface 405; and, an internally connected game processor. The gaming machine 103 may further include memory with a set of pre-loaded games (e.g. at least one primary in-revenue game for individual play such as the Jambalaya Jackpot® game and at least one group play game such as a tournament or competition game, and perhaps one or more interactive or non-interactive bonus games such as those described below with reference to, FIGS. 9B, 10, and 11) comprising program coding executable by the game processor. The game process may be mounted on a printed circuit board with ports connecting to various sub-assemblies housed in or about the gaming machine cabinet in accordance with one or more embodiments of the invention. While gaming machine 103 is shown as an upright gaming machine cabinet style, various cabinet styles may be utilized, including a slant top cabinet style and a bar top cabinet style (where the cabinet may be part of a bar/table top and/or housed therein).

Each reel displayed by or through display 115 includes a series of symbols visible in a display area; for example, in the case of mechanical reels, a portion of each reel is visible in a display area through a window or panel. With the reels in a stationary position, the symbols visible in the display may be viewed as an array of symbols. During a wagering game, such as may be initiated by a player, the reels may be spun about an axle or simulated to spin under the control of a game processor which may randomly or pseudo-randomly determine the game outcome (or obtain the game outcome from a central determination or game server) and cause the reels to stop in accordance with the determined game outcome. Alternatively, the game processor may cause the reels to stop at random or pseudo-random stop positions and then analyze the displayed symbols to identify the outcome for the play.

One or more paylines, combinations, or patterns of the symbols including those visible through the display area may be correlated to a game result payable in accordance with a paytable, such as may be displayed on display 113. The reel display area may thereby be used to display the game result to one or more patrons standing in front of gaming machine 103. While example gaming machine 103 includes a set of five reels, various numbers of reels may be selected or utilized in an implementation of one or more embodiments, such as one, two, three, four, five, six, or seven reels, and so forth. In fact, the wagering game may not include reels, and may alternatively display, for example, a video card game (e.g. poker, blackjack), bingo, keno, or roulette. Panel dividers or frames may be painted, etched, virtualized, etc. onto the display area to provide a separate viewable area or window for each reel. The windows may serve to focus attention to the visible portion of the reels and, in the case of mechanical reels, to overlay reel dividers and/or the space between reels.

Alternatively to painting, etching, etc. onto the display area of the window or panel, display 115 may include a panel, such as a flat panel LCD or LED display, which may overlay the display area and be programmed to display an opaque frame image except over the display area (which may be transparent or translucent) during an operating mode when either the primary or group play game are operational, depending upon the selected design. In such case, the panel may be instructed by the game processor to display a bonus or feature game that may be triggered randomly or pseudo-randomly through an RNG, by a threshold count, by a countdown, or by the appearance of one or more special symbols (any of which may be triggers operable through programming executed by the game processor or a network-connected external server), and, may be programmed to enable player interactivity, such as requiring a player to select a displayed button or press an area of a touch sensitive panel overlaying an item, in order to cause the game to perform additional steps and provide one or more bonus or feature game outcomes and awards to the player.

Additionally, in one or more embodiments, the reels may be implemented using flexible reel strips, such as FOLED (flexible organic LED) reel strips, wherein one or more symbols may be programmed dynamically to vary the symbol and/or its appearance, either within a game or enabling conversion from a first game to a second game (i.e. in-revenue individual game to group play game and vice-a-versa. Additionally, one or more display panels may be implemented to present each reel virtually. In the case of virtual displays of the reels, the symbols may be fixed or animated on each of the simulated reels. Also, overlapping display panels may be implemented to generate video or display effects over reels; for example, display 115 may be implemented to include transmissive (e.g. Aruze or WMS transmissive display panels) or transparent (e.g. Bally® transparent display panels) panels configured to display visual effects together with a set of reels (mechanical or virtual) under the control of the game processor during the operation of an in-revenue or out-of-revenue wagering game. In the case of virtual reels, the virtual reels may be recessed a distance from the front surface of the display area and segregated by dividers similar to dividers separating mechanical reels, which may provide a spatial characteristic (e.g. a PureDepth® display panel).

In one or more embodiments, the game processor operating the wagering game and controlling game lighting and effects in many instances is implemented as a microprocessor, such as an Intel Pentium® or Core® microprocessor, on a printed circuit board including one or more memory devices positioned within gaming machine 103. In alternative implementations, the game processor may be remote from gaming machine 103, such as on a server network connected to gaming machine 103 (e.g. gaming network 100, FIG. 1), in which case the game operation as described herein may be accomplished through network communications to control the display of the game on gaming machine 103 including the audio, visual, and game effects. It should be noted here that any terms indicating relative position used in this disclosure and the accompanying claims such as "front," "rear," "lateral," "back," and "top," for example, are used with reference to the operating position of gaming machine 103 shown in FIG. 4A.

Figure 4B:
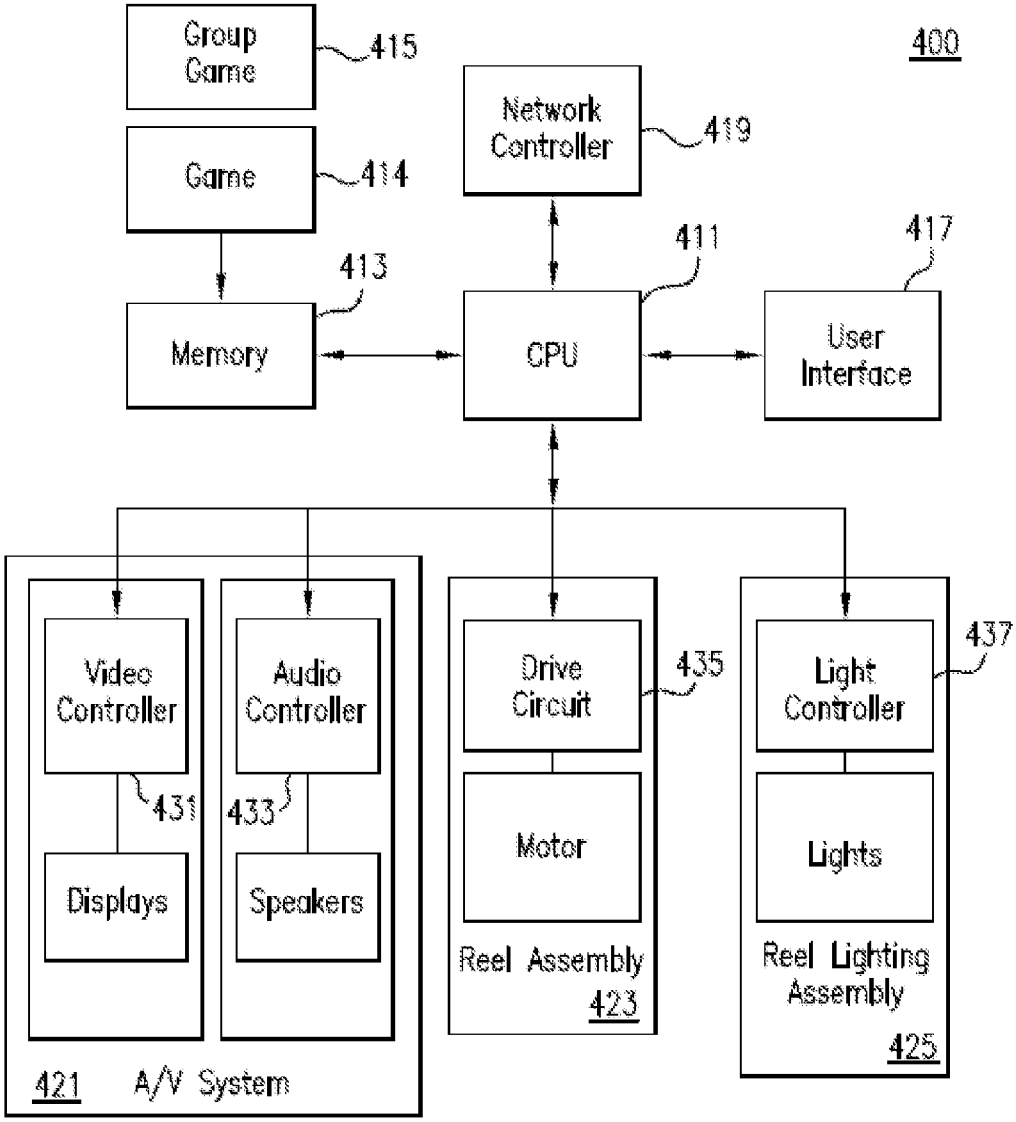
FIG. 4B illustrates an example logical layout of a convertible gaming machine in accordance with one or more embodiments.

Referring to FIG. 4B, an example control structure 400 of gaming machine 103 is shown in accordance with one or more embodiments of the present invention. Game processor (CPU) 411 may comprise a conventional microprocessor, such as an Intel Pentium® or Core® microprocessor, mounted on a printed circuit board with supporting ports, drivers, memory, and coding to communicate with and control gaming machine operations, such as through the execution of coding stored in memory 413 including one or more individual wagering games 414 and one or more group play games (e.g. tournaments, competitions) 415. Game processor 411 connects to user interface 417 such that a player may enter input information and game processor 411 may respond according to its programming, such as to apply a wager and initiate execution of a game. Game processor 411 also may connect to a network, such as a casino server network (which may be implemented over one or more site locations) which may include host, remote game play, central determination, progressive, player tracking, and accounting server functionality, through network controller 419 to enable network monitoring and sharing of data and information between respective of the servers in the network and gaming machine 103. Game processor 411 may also connect to various devices within and about the gaming machine including A/V system 421, reel assembly 423, and reel lighting assembly 425 through respective controllers, such as one or more video controllers 431, audio controllers 433, motor drive circuit controller 435, and light controller 437. In the case where the reels are implemented using a video display, reel assembly 423 and reel lighting assembly 425 may be modified or eliminated depending upon the desired configuration; for example, in one or more embodiments, it may be desirable to use reel lighting assembly 425 to amplify or provide various light effects in conjunction with a video reel display during game play, alternatively this functionality may be absorbed into the video display coding and presentation.

Generally, activity at gaming machine 103 may be initiated by a player inserting currency and/or a player card into a bill acceptor and card reader, respectively. Upon insertion, a signal is sent to game processor 411. In the case of the insertion of a player card, the card reader transmits card information which is directed through network controller 419 to a player tracking server connected to the network. Player data is transmitted to gaming machine 103, and, responsive to the data, game processor 411 may execute coding causing player data and a display (and possibly an audio) command to be transmitted to one of the video and/or audio controllers instructing the controllers to display player information on a respective display and possibly issue an audio greeting through one or more respective speakers. Concurrently, the bill acceptor sends a signal to game processor 411 which may include an identification of the currency that has been read, and game processor 411, in accordance with its coding, may convert the currency amount to credits and transmit a store and display signal to a credit meter and its associated display ("Credits"). Once credits have been associated with the credit meter, the player may (for a reel-type game) select the number of paylines and credits per line that the player wishes to wager, whereupon game processor 411, in accordance with its coding, receives the wager information from user interface 417, transmits accounting and display information to the payline ("Lines"), credits per payline ("Bet per Line"), and total bet ("Total Bet") meters and displays, transmits an update to the credit meter and display ("Credits") deducting the amount of the total bet, and initiates the wagering game.

In the case of Class III gaming devices, when a game is initiated, a random number generator (RNG) is operated by game processor 411 to determine the game outcome. Commonly, game processor 411 is positioned within gaming machine 103 and configured to manage the operation of the gaming machine components, such as shown in FIG. 4B; however, the game processor may be either onboard or external to a gaming device (such as an electronic tablet (e.g. Apple iPad or gaming specific tablet), personal data assistant (PDA), cellular telephone (e.g. Blackberry or Apple iPhone), surface table (e.g. Microsoft/IGT touch sensitive gaming surface table)) played by a player. Therefore, when the player places a wager and initiates play of the game through user interface 417 of the gaming device, the game processor may be onboard or remotely located such as within a network gaming server. In the latter case, an onboard microprocessor, controller, or digital signal processor may execute coding to transmit the wager and game request information through the network and the remote game processor may operate an RNG to determine the game outcome. In one or more embodiments, coding may be implemented and stored in memory 413, game memory 414, and group game memory 415, executable by game processor 411 to control the primary and feature game execution and to control associated electro-mechanical devices, such as reel lighting, speakers, and reels through respective video, audio, reel drive motor controllers, and lighting controllers 431, 433, 435, 437.

Program coding may be stored to execute and/or integrate gaming device operation with a tournament or competition, such as described herein, where a selected gaming machine 103 from a bank may be designated as control center server 101. For example, each gaming machine 103 of a bank may include coding executable by the designated host game processor to initiate and operate a tournament or competition game and also include coding to respond as a client gaming machine on the bank responsive to a primary controller. One of the gaming machines 103 may be designated as the primary controller responsible for converting operating modes of the selected banks of gaming machines 103, operating tournaments or competitions, and controlling content display on one or more displays, such as overhead display 111 and/or respective displays 113. In the case that the primary controller becomes unavailable, a second gaming machine may be designated as the backup primary controller and a rule of succession may be coded into each of gaming machines 103 of a respective bank. Each of the gaming devices may include monitoring coding executable on an ongoing periodic basis to ascertain which gaming device is the active primary controller during a given time period. Alternatively, the primary controller may be responsible to execute periodic polling of each of gaming machines 103 of the respective bank; and, in the event that the backup primary controller does not receive a poll within a designated period, the backup primary controller may commence operation as primary controller, commence polling operations, and commence execution of coding to randomly determine when to initiate the associated tournament game.

In one or more alternate embodiments, gaming machine 103 may have multiple games pre-loaded including a primary game (generally operational for in-revenue individual play) and a group play (tournament or competition) game, wherein either game may be operable by the game processor (depending on the setting or operating mode as may be controlled by control center server 101 through network commands) by executing respective of the game codes stored in memory. By example, the primary game may initially be operable for in-revenue individual play; the group play game may be initiated by a command from control center server 101 whereby gaming machine 103 may be converted from in-revenue individual play to group play (which may be in-revenue or out-of-revenue depending on the game rules and associated programming).

Once initiated, the group play game may be displayed on one of the displays operable by gaming machine 103, such as display 113 or 115 (reel display area), where a video representation of the group play game may be presented by either replacing or overlaying primary game display content. For example, if display 115 includes mechanical reels, display 115 may also include an overlaying panel (such as a flat panel display) which may be changed from a transparent mode during primary (or alternatively, group play) game operation to an opaque mode during group play (or alternatively, primary) game operation by instructions from the game processor instructing display 115 to mask the mechanical reels and display a video game associated with the group play (such as a reel-based game, video card game (e.g. poker or blackjack), bingo, keno, roulette or other wagering-type game). In the case where display 115 comprises two or more displays with or without mechanical reels, one or both displays may be used separately or together to display video content for the primary game and the group play game (for example, special effects or symbols may be rendered through an overlaying display while the underlying display displays the reels of the primary game or the field (or surface) of the group play game, depending upon which game is being shown or played).

Figure 5:
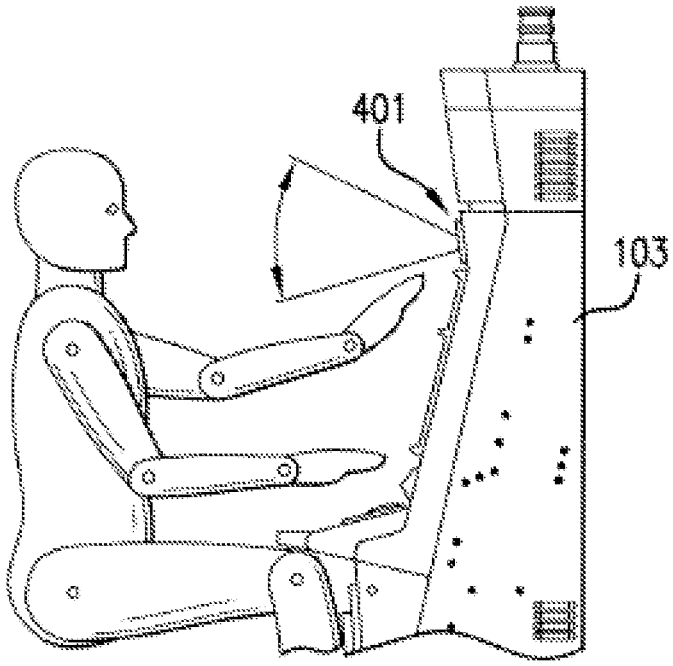
FIG. 5 illustrates an example side view of a player and gaming machine with a camera and associated camera angle in accordance with one or more embodiments.

Referring to FIG. 5, an example side view is shown of a player and gaming machine 103 with camera 401 and associated camera angle in accordance with one or more embodiments. When activated, camera 401 may capture real-time images of the player which may be transmitted directly (or indirectly through an intermediate processing device) to one or more displays in accordance with programming executed by the game processor and requests by control center server 101 (or another gaming machine 103 or remote device operating as the control center server).

Figure 6:
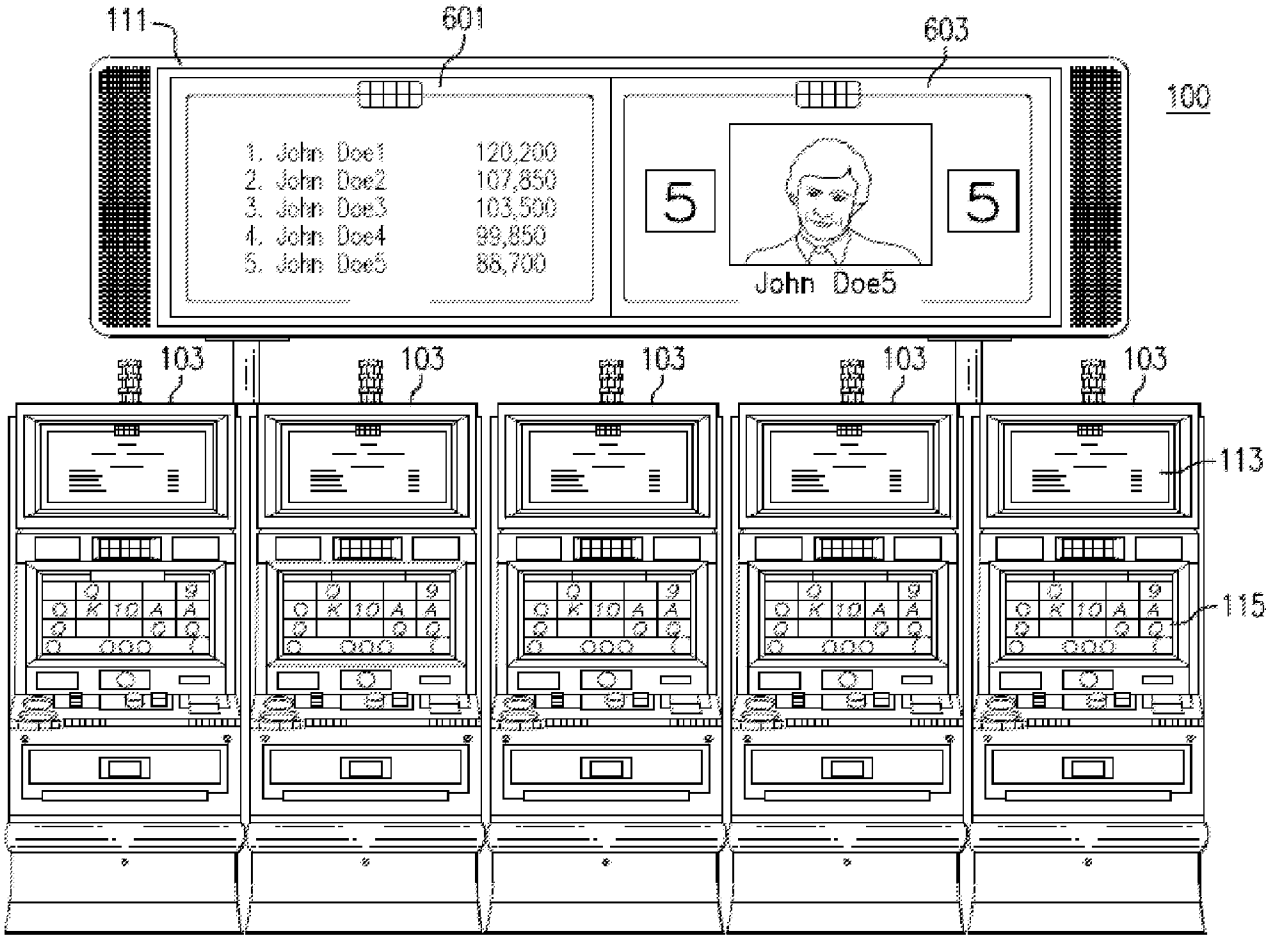
FIG. 6 illustrates an example bank of gaming machines in out-of-revenue mode and with an overhead display showing an example real-time tournament or community game leader board and player video feed in accordance with one or more embodiments.

Referring to FIG. 6, an example embodiment of convertible in-revenue and out-of-revenue gaming system 100 is shown with a bank of gaming machines 103 in a tournament mode (which may be operable either in out-of-revenue or in-revenue modes) and with overhead display 111 showing an example real-time leader board 601 and player video feed 603 in accordance with one or more embodiments wherein players at each of the gaming machines 103 compete by playing their respective gaming machine 103 and accumulating a total award based on their play. In the example, each of gaming machines 103 are operating the same game as shown on display 115, and leader board 601 is displayed on display 113 as well as on overhead display 111. Overhead display 111 also displays player video feed 603 which includes the image of one of the players. In the example shown, the video image displays the player, the player's name, and the player's position in the competition (5th place as reflected by the '5' displayed adjacent the player's image). Leader board 601 includes the first five player's position, name, and accumulated point total. Leader board 601 may be updated in real-time to show current positions and accumulated point totals of the respective players. Additionally, leader board 601 may sequentially display standings of each of the players, such as by cycling through all the player positions from first through the total number of participating players. On each of gaming machines 103, display 113 may be personalized to show the top players' positions while also showing the name of the player playing the respective gaming machine displayed as a header and the player's name, position and accumulated points highlighted on the leader board. In the example, the name of the respective player, position, and points may be circled on the respective display 113 so that the player at that gaming machine 103 may readily identify their ranking. In the case where the respective player is not in the top five, the player's name, position, and accumulated points may be appended to the bottom of the displayed leader board on display 113 of that player's gaming machine 103.

In one or more embodiments, video feed may be delivered to each of displays 113 during an event to show video feeds of each of the participating players, such as by cycling every five seconds to rotate real-time or quasi-real-time images of the players, and/or to show a video feed of the respective player during the course of the event.

In one or more embodiments, the player video feeds and the leader board may be broadcast to wireless devices, such as cellular phones. For example, a gaming facility or operator may maintain a website server and website, enabling individuals to dial-in or login to the website to receive audio-visual broadcasts of events occurring within the facility. The website server may receive updates through the network of various events that may be occurring simultaneously and update web pages associated with the website, enabling visitors to the website to view streaming and fixed content. The website may be maintained through a controlled-access intranet or broadly accessible internet service. In the case of controlled-access, each patron of a gaming facility may be provided a temporary username and password, such as may be provided during a patron's stay at a resort associated with the gaming facility. Patrons may thereby use their remote wireless device to enroll in a gaming event and pay an entry fee, monitor their time to attend the gaming event, and monitor their position within a gaming event in the case where there are more than one session or round associated with the gaming event.

Additionally, players enrolled in events may receive notifications, such as an automated phone call or text message, to advise the player of the time to attend the event, to advise the player of a player's position change within the event, or to advise the player of a delay in the event. Players may, for example, request notification at the time of enrollment or thereafter by using an identifying process, such as entering a username and password, to connect to a server and database with event and player information. Such notifications may also occur through a display and/or speaker at a gaming machine 103 being operated by a player, for example, if the player has requested a notification concerning an event and the player has a player card inserted in a gaming machine. The event server or the website server may query the player tracking server if the player's card is identified as connected to a gaming machine 103, identify the gaming machine 103, and transmit an instruction to the gaming machine 103 to display the notification on one of the associated displays. In another alternative, player cards with embedded identifiers (and enrolled cellular phones) may be identified through positioning systems within a gaming facility, such as GPS or related systems or proximity detection systems. Once an enrolled player is detected, a notification may be transmitted to a nearby display and/or speaker.

Similar features may be provided through an internet portal enabling visitors or patrons to access a website and similar restrictions may be implemented, if desired. For example, different levels of access may be provided to general visitors to the site versus current or past patrons to the gaming facility and/or associated resort.

In an alternate embodiment, patrons or visitors may dial-in to an audio-visual broadcast that may be accessed through their respective wireless or network connected devices, such as cellular phones or personal computing devices (e.g. personal computers, electronic pads, personal organizers, etc.). The content may be provided similar to a television broadcast wherein a schedule of events may be provided along with broadcast times. The broadcast network may be implemented as a closed circuit broadcast providing restricted access, or may be implemented as an open broadcast.

At the completion of the tournament event, a celebratory event may be displayed on overhead display 111 to name the winner and present fanfare. The celebratory event may be displayed on one or more of displays 113, for example at the winner's gaming machine 103. In one or more embodiments, the streaming videos of the event may be recorded along with the leader board updates for the duration of the event, such that each of the participating players may be provided a personalized copy of the event, such as a DVD. In other alternatives, the event may be re-broadcast or accessible on-demand, such as through the gaming facility's website as described above.

Figure 7:
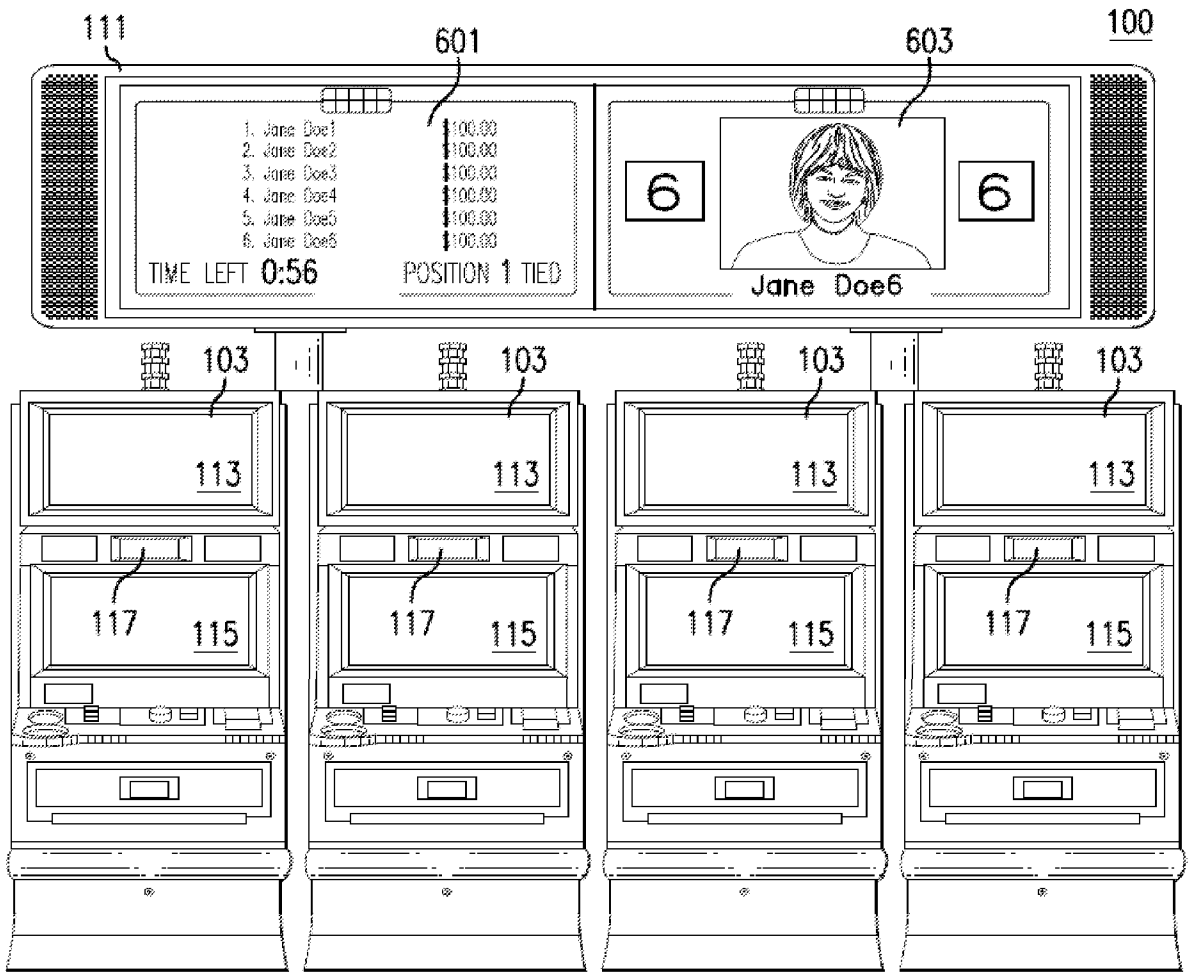
FIG. 7 illustrates another example bank of gaming machines with an overhead display showing an example real-time tournament or community game leader board and player video feed in accordance with one or more embodiments.
Figure 8:
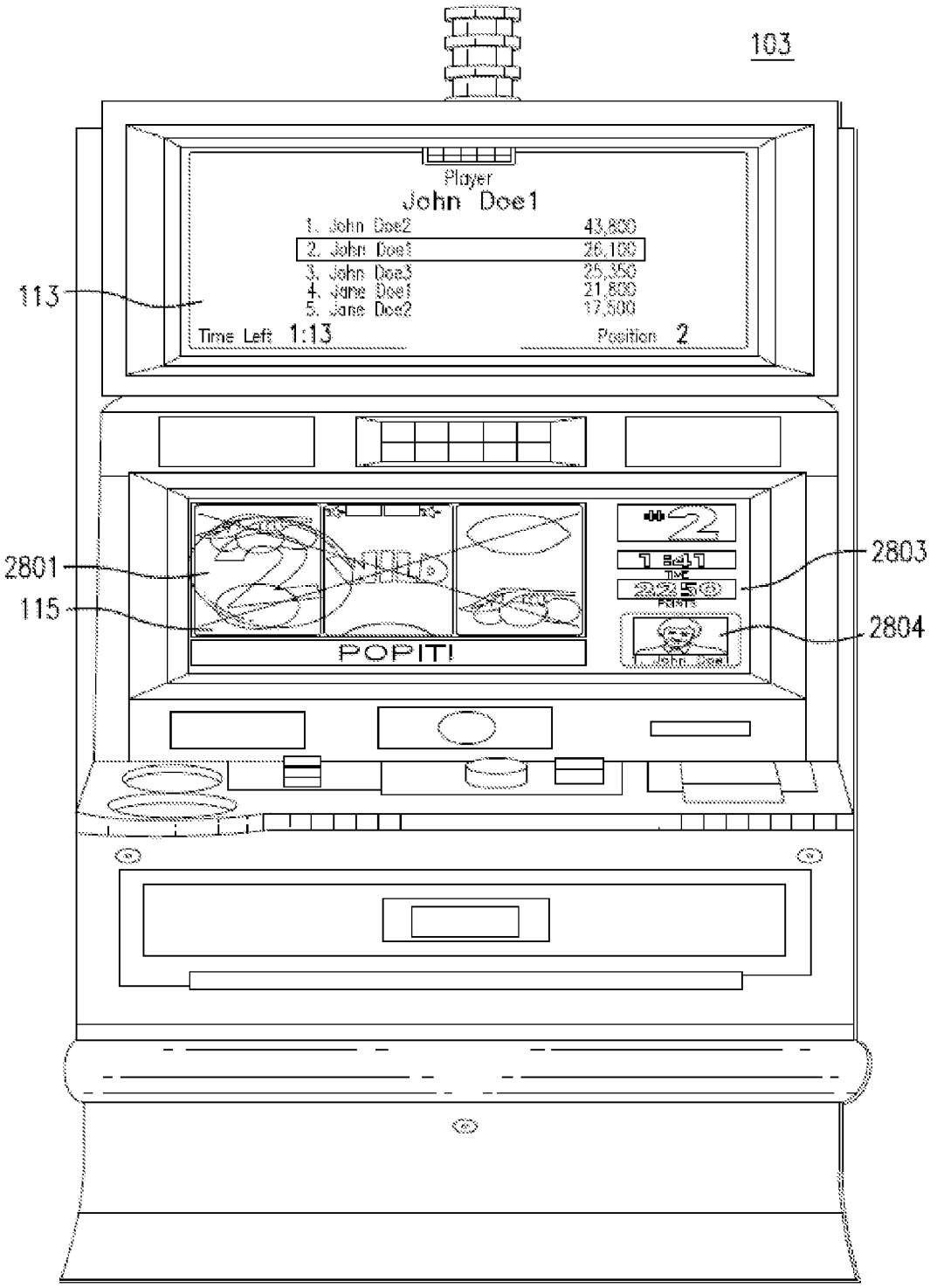
FIG. 8 illustrates a front view of a gaming machine including a player dashboard and interactive game feature in accordance with one or more embodiments.

Referring to FIG. 7, an embodiment of convertible in-revenue and out-of-revenue game system 100 is shown with a bank of gaming machines 103 and overhead display 111. Overhead display 111 shows an example real-time leader board 601 and player video feed 603 in accordance with one or more embodiments. Additionally shown with leader board 601 is a "Time Left" countdown. Instead of accumulated points, the player's accumulated dollars are displayed.

Referring to FIG. 8, gaming machine 103 is shown including interactive game feature 2801 and player dashboard 2803 in accordance with one or more embodiments. In the example embodiment, interactive game feature 2801 includes a randomly or pseudo-randomly initiated virtual balloon (that is, an interactive game graphic) displayed on primary display 115 in overlaying relation to a portion of the displayed primary game (the primary game in this case being a tournament game presentation) and a "POPIT!" message displayed along the lower portion of primary display 115. This feature is referred to in a preferred embodiment as "Pop and Win." Responsive to the appearance of the virtual balloon, a player may press the area associated with the virtual balloon (in the case in which primary display 115 includes a pressure-sensitive display surface), and obtain bonus credits (or points) which may be displayed on a paid meter located on or about primary display 115, and added to a credit meter also located on or about primary display 115. Display 113 includes a display of the player's name and the leader board for the associated tournament (or competition), the time remaining for the event (which may be one of one or more heats associated with the tournament), and the player's position in the tournament (which may be highlighted on the leader board, e.g. as shown). Player dashboard 2803 may include a personalized display updated in real-time of the player's position, time remaining in the event, the player's score, and a picture-in-picture (PIP) 2804 of the player's video stream as captured by camera 401 (see FIGS. 4A and 5) at the player's gaming machine 103.

Alternatively to a pressure-sensitive display surface, a button on the button deck may be activated when the virtual balloon appears and the button may be illuminated to direct the player's attention to the button to press in order to obtain the additional credits. The button may additionally include a "POPIT!" inscription readable by the player.

During competitive play, such as during a tournament as depicted herein, a player is provided a predetermined amount of time to accumulate credits (or points) by playing the competition game as rapidly as the player is able, such as by repetitively pressing the "PLAY" button. The player that obtains the most credits wins first place, the player with the next most points wins second place, and so forth. Prizes or awards may be provided to the winning players according to their placement. Some competitive play may be provided in heats in which one or more winning players from each heat advance to a next heat and so forth until a final heat is conducted with the qualifying players.

Credits may be conventionally awarded according to a paytable. Additionally, bonus credits may be accrued by the random appearance of interactive game feature 2801, such as the display of one or more virtual balloons with which the player may interact by 'popping' the balloons while the balloons are displayed. The 'popping' interaction may occur by the player pressing a pressure-sensitive display in the area of the displayed balloon or pressing an activated "POPIT!" button on the player's button deck. In one or more examples, a balloon may initially appear in one area of primary display 115 and appear to float to another area and/or grow from one size to another size. Additionally, while the credit value for popping the balloon may be a fixed amount for each balloon, the amount payable for popping the balloon may vary depending upon the balloon. For example, one balloon may have a value of ten credits, while another balloon may have a value of twenty credits. When popped, the value of the balloon may be credited to the player's credit meter at the gaming machine 103. In one or more embodiments, the award amount for a balloon may be a pre-determined amount which may be reduced from the time the balloon appears until the balloon is ultimately 'popped' by the player. For example, an initial award associated with the appearance of a balloon may be ten credits, and the award amount may drop by one credit each second until either popped (e.g. if the balloon is popped after one second passes and prior to two seconds passing, the award to the player may be nine credits) or after ten seconds the balloon disappears from view if not popped (in which case, the balloon may either appear to float out of the display area or vanish from the display). In one or more cases, multiple balloons may be displayed simultaneously and each balloon may appear for different periods of time as well as have different associated award values.

In one or more embodiments, one or more bonus games may be randomly or pseudo-randomly triggered, such as by an RNG executed by the game processor or by the appearance of one or more bonus-activating symbols during play of the primary game (which may be a tournament game). In some embodiments, the trigger may be generated at a location remote from the given gaming machine (such as at a tournament controller implemented through control center server 101 in FIG. 1 for example) and communicated to one or more gaming machines in the gaming system. Example bonus games may be a reel-based or table-style game. During tournament or competitive play, the bonus game may: a) be displayed, such as on a side panel of primary display 115 or top box display 113, b) play one or more game sequences simultaneously with continued play of the primary (tournament) game by the player, and c) award bonus credits in accordance with a bonus game paytable and in addition to primary (tournament) game awards. The bonus game may or may not include player interactive game features 2801, such as described above with the virtual balloon interactive bonus feature. Also, the bonus game, either interactive or non-interactive, may award credits separately from credits awarded for play of the tournament game. Thus the credits awarded for a bonus game may not affect the player's score for a given tournament during which the bonus game was conducted.

In some embodiments of the interactive game feature, 'popping' the balloon may cause a player to win a prize directly instead of accumulating bonus credits or tournament points. Such prizes may include cash prizes, non-cash physical prizes (e.g. a car), or promotional prizes. This version is referred to in a preferred embodiment as "Pop and Prize." The directly-awarded prizes may be awarded in addition to, or in lieu of, prizes awarded based on points accumulated in the tournament. In the context of this disclosure, a "promotional prize" comprises an offer or award related to a particular good or service that is desired to be promoted or advertised by the casino or game operator or their advertising partner or client. Examples of promotional prizes include gift certificates, coupons, or vouchers to a spa, hotel, restaurant, golf course, or other business. For example, the player pops a balloon on the screen and the player wins $5 or a gift certificate to the casino's spa or a watch or a two-night stay at the casino. The prizes won are stored at the central system and on the player's screen. After the tournament or the current round is over, the player is given the actual prize or the gift certificate. These gifts may or may not replace the tournament prizes given to the top finishers. In the preferred Pop and Win embodiment, the player pops a balloon, but many other objects could be used instead of balloons, such as eggs, water balloons, Halloween pumpkins, etc. Further, other interactivity may, of course, be used that does not involve popping anything.

In interactive game feature embodiments that award prizes directly, the paytable may be adapted so that a gaming system administrator can easily add a list of interactive game feature bonus prizes into the paytable, or alternate between a paytable in which bonus points are awarded or a paytable in which prizes are awarded directly. This feature may be used for out-of-revenue slot tournament games but it could also be used for standard in-revenue slot games or any other electronic casino game. The software works in such a way that a system administrator could add a list of prizes into a database table and the software would work with the Pop and Win game so that instead of bonus points being awarded when a balloon is popped by the player, a prize could be awarded instead. In some versions, the game would give away tournament points and prizes. In other versions it would give one or the other. The available prizes in the table could have an equal chance of being received by the player or some prizes may be weighted so that more valuable prizes are offered less frequently.

These random interactive features could pop up based on certain criteria or certain frequency, or players could get prizes when a player reaches certain point levels in the tournament or when they jump into first place while they are playing. Many different thresholds could be created for why the player gets a balloon with a prize instead of bonus points. The player may have a limited time, such as 3 seconds to pop the balloon or the player gets the award if they pop the balloon or not.

The player may win part of a prize when they pop a balloon, such as they win half of a car. (For example, they pop a balloon and get a picture for the front half of a car and during the tournament they need to pop a balloon with a picture of the back half of the car to win the whole car.) Or, they pop a balloon and get a key and the key may or may not start a car that they are giving away at the casino.

All of the above examples could also be used with in-revenue games. When a player is playing a standard spinning reel game or poker or keno game, the balloons appear on their game screen and require popping to win a prize. As a result of popping the balloons, the player could win a prize that could be worth credits or physical prizes or gift certificates. Other interactive features may, of course, be used.

Other examples of interactive or non-interactive bonus game features may include the display of an animated wheel. The wheel may include various awards that may potentially be awarded depending upon the location of the wheel and a selector or indicator when stopped. In a non-interactive wheel-based bonus game, the wheel may be spun and stopped by the game processor in accordance with an RNG. In the case of a wheel-based bonus game provided as an interactive game feature, the player may either press the wheel to cause it to stop or press a designated button on the player's button deck. In the interactive case, the award may be skill-based. In the event that it is desired to reduce or eliminate skill as a variable in obtaining an award, then the award obtained through the wheel may be increased, such as with a surprise bonus award (e.g. a special exploding balloon or package bonus) which when totaled with the wheel-based award achieves a value pre-determined by an RNG or within a pre-determined percentage of the RNG-based value. The pre-determined percentage being the percentage variability permitted based on skill, for example, ten percent.

Another example bonus game may include the display of an animated character or object which represents an interactive game graphic (e.g. a person, animal, or item); for example, a frog or rabbit which may hop across the primary display and which the player may select (or capture) by pressing the area of the pressure-sensitive display where the animated character is displayed or by pressing an activated button associated with the animated character. By selecting the animated character, the player may obtain bonus credits in addition to any award obtained based on the primary game.

Figure 9A:
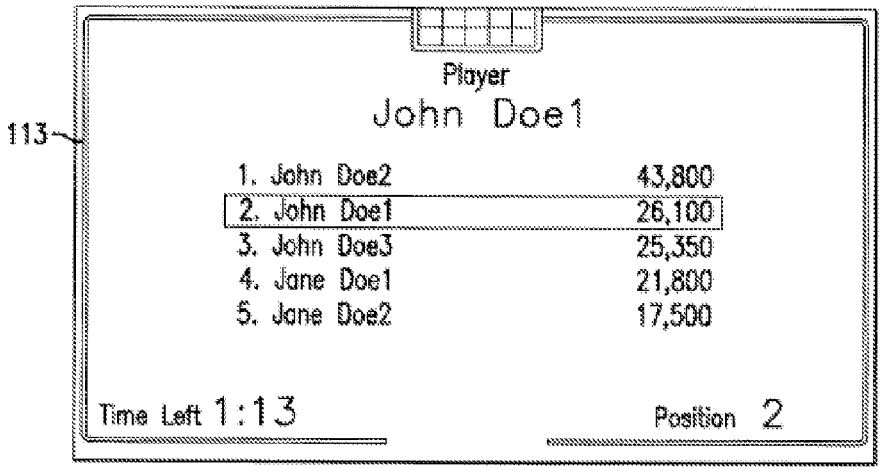
FIG. 9A illustrates a front view of a top box display of the gaming machine of FIG. 8 in tournament (in-revenue or out-of-revenue) mode in accordance with one or more embodiments.

FIG. 9A shows a close-up view of display 113 of gaming machine 103 in tournament (in-revenue or out-of-revenue) mode in accordance with one or more embodiments. As shown, display 113 includes a display of the player's name, the leader board for the event, the time remaining in the event, and the player's position.

Figure 9B:
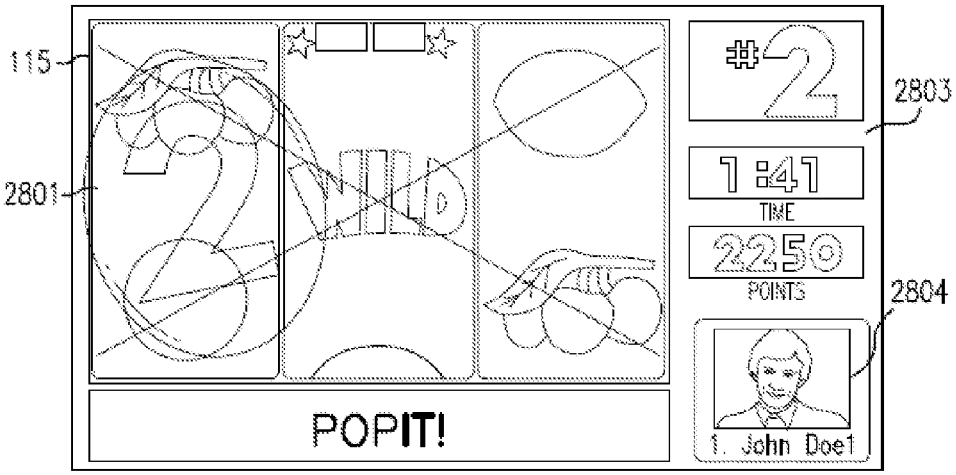
FIG. 9B illustrates a front view of a primary game display of the gaming machine of FIG. 8 including a player dashboard and interactive game feature in accordance with one or more embodiments.

FIG. 9B shows a close-up view of display 115 of gaming machine 103 in tournament (in-revenue or out-of-revenue) mode in accordance with one or more embodiments. As shown, display 115 may include a display of player dashboard 2803 and interactive game feature 2801 as well as the primary game. As shown, player dashboard 2803 may include a display of the player's position, the time remaining for the event, the player's score, and a PIP 2804 of the player as captured by camera 401 of the player's gaming machine 103. In the event that the tournament includes other players playing simultaneously, the PIP 2804 may be programmed to rotate through and present the captured video images of each of the other players; in which case, the video streams of the respective players may be transmitted over the network connecting the respective gaming machines 103 participating in the tournament and each of the game processors may be programmed to periodically rotate its own video feed and the video feed from each of the respective gaming machines 103, so that real-time video feed of each participating player is periodically displayed on each player dashboard 2803. If desired, the programming may be set so that at a given gaming machine 103, the video feed displayed on the PIP 2804 is limited to a rotation of the video feed of the respective player and that of the players on the leader board.

Player dashboard 2803 may also include a message area wherein special wins (or prizes) and system communications to the player may be displayed, e.g. notification of player position changes or a message for the player to take some action. Player dashboard 2803 may be modifiable to display one or more custom designs associated with one or more tournament game themes. In addition, during tournament mode, reels on display 115 may be enlarged and on-screen buttons which don't pertain to tournaments may be removed (i.e. select lines, bet per line, help, etc.). Additionally, the background color of player dashboard 2803 and top box display 113 may change colors throughout the tournament when a player's position changes. For example, the following background colors and positions may be associated as follows: $1^{st}$ place is red, $2^{nd}$ place is green, $3^{rd}$ place is purple and all other positions are blue. As background colors change in real-time, participants and spectators may easily note position changes.

In some implementations, gaming machine 103 may be configured to give the player certain control over the graphics displayed on display 115, and/or top box display 113. For example, gaming machine 103 may be configured so that the player may resize player dashboard 2803 and/or the game presentation area to the left showing the three reel facsimiles. In one implementation, display 115 is a touch sensitive display and a player may compress player dashboard 2803 to take up less area on the display by simply touching the area of the player dashboard or a designated control on the player dashboard (a designated control not shown in the figures). Alternatively, a player may compress or expand the game presentation area by touching some point in that area of display 115. It will be appreciated that any number of conventional controls may be included with gaming machine 103 to facilitate either compressing or expanding player dashboard 2803 and/or compressing or expanding the game presentation area shown to the left of player dashboard 2803 in the figures.

Figure 10:
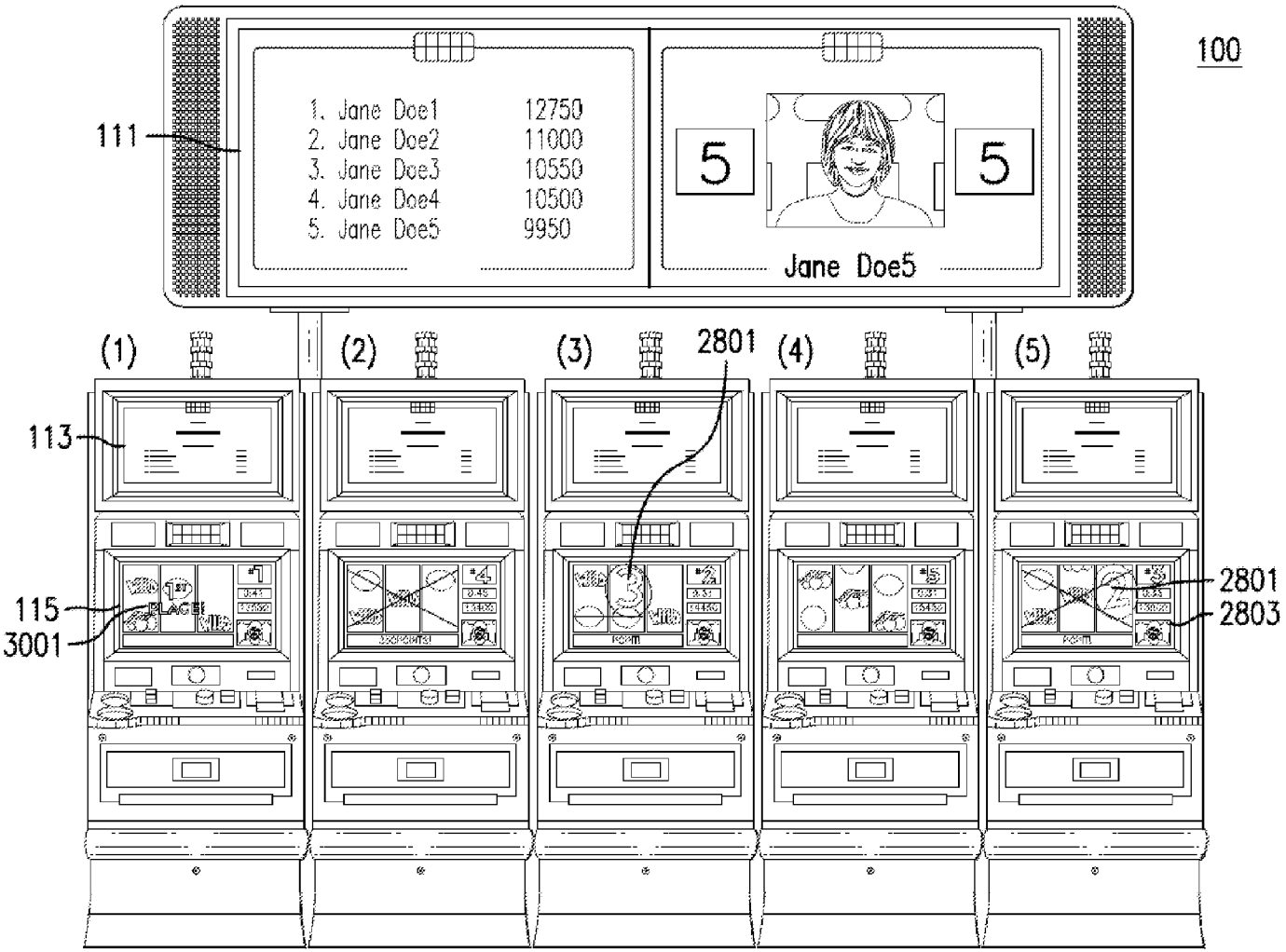
FIG. 10 illustrates a convertible gaming system including an overhead display operating in tournament (in-revenue or out-of-revenue) mode wherein player dashboards are displayed on each gaming machine in accordance with one or more embodiments. Additionally, player interactive features are shown displayed on the primary display of gaming machines (3) and (5) of the bank, and a display overlay is shown on the primary display of gaming machine (1) indicating that the respective player is atop the leader board.

Referring to FIG. 10, convertible gaming system 100 is shown with overhead display 111 and a bank of gaming machines 103 operating in tournament (in-revenue or out-of-revenue) mode wherein player dashboards 2803 are displayed on each gaming machine 103 in accordance with one or more embodiments. In the arrangement shown in FIG. 10, control center server may be implemented within one of gaming machines 103 in the bank, remotely through a server connected over a network to gaming machines 103 and overhead display 111, or as shown in FIG. 1 at reference number 101, as described above. Additionally, example player interactive game features 2801 are shown displayed on primary display 115 of gaming machines 103 (third and fifth from the left) of the bank; and, display overlay 3001 ("1st Place!") is shown on primary display 115 of the left most gaming machine 103 indicating that the respective player is atop the leaderboard (displayed both on overhead display 111 and displays 113 of gaming machines 103 in the bank).

Figure 11:
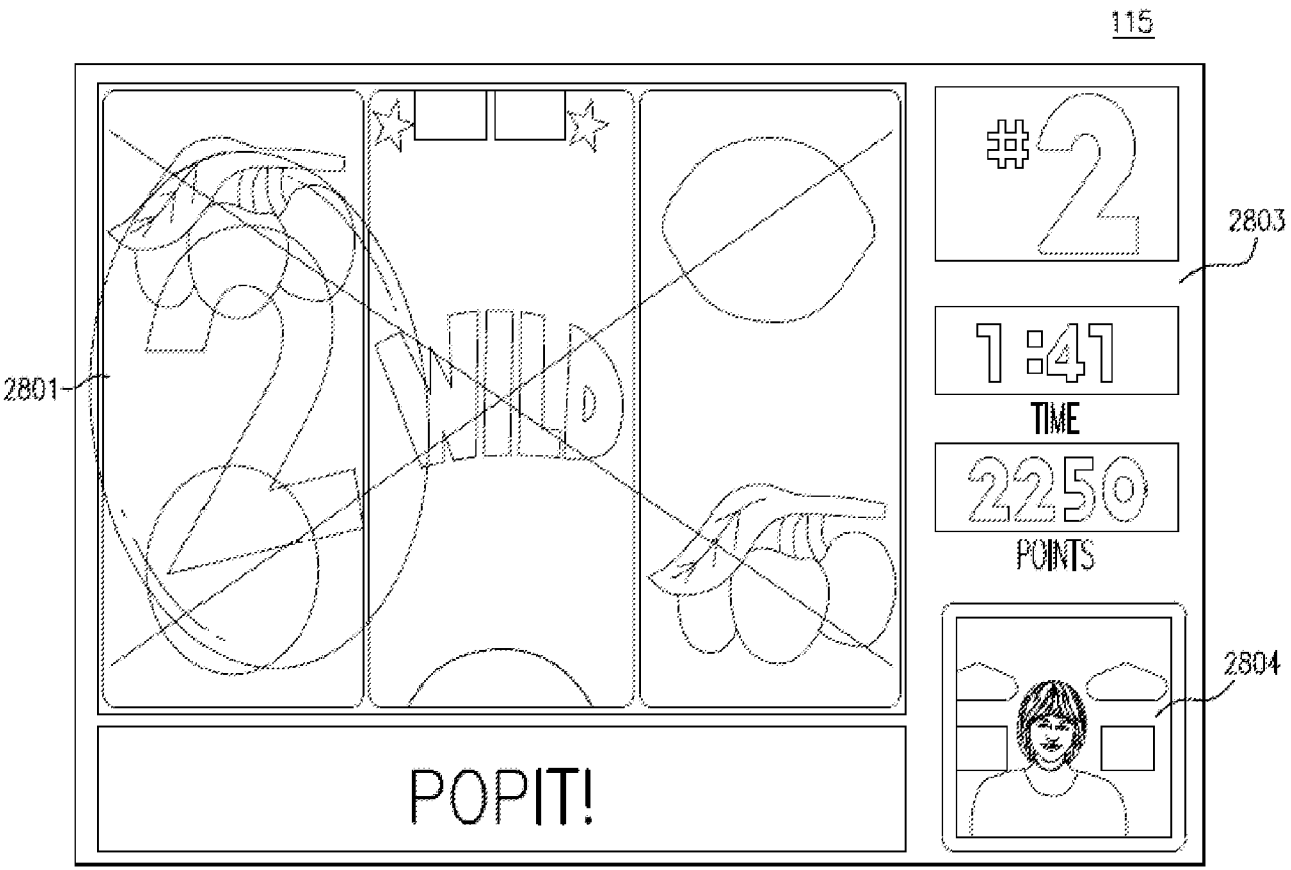
FIG. 11 illustrates a close-in view of the primary display of gaming machine (3) of the convertible gaming system shown in FIG. 10 wherein the player dashboard and player interactive feature are shown.

FIG. 11 is a close-in view of primary display 115 of the third gaming machine 103 of the convertible gaming system shown in FIG. 10 (that is, the third from the left in FIG. 10) wherein player dashboard 2803 and example player interactive game feature 2801 are shown.

Figure 12:
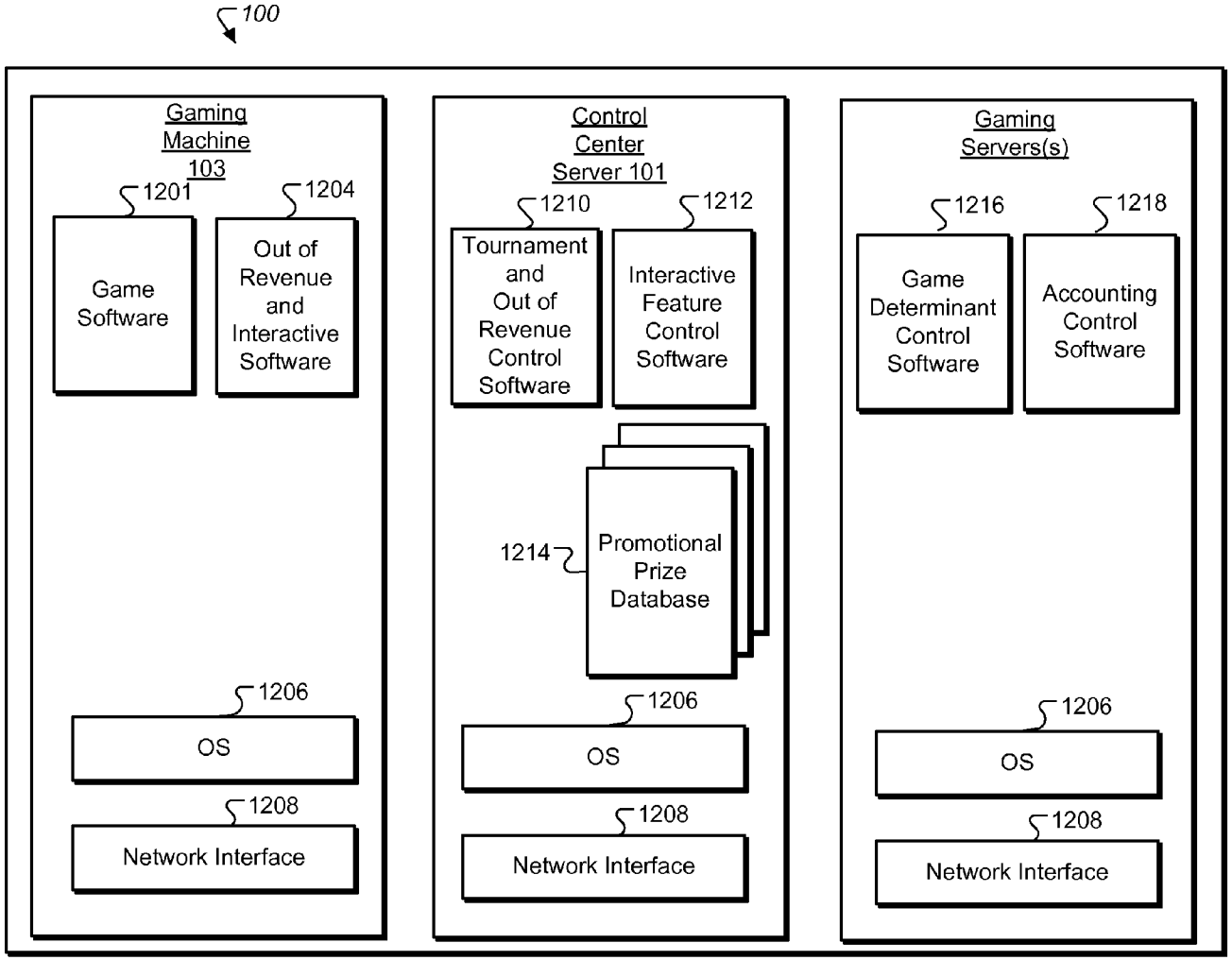
FIG. 12 is a high level software block diagram of certain elements of a gaming system according to one or more embodiments.

FIG. 12 is a high level software block diagram of certain elements of a gaming system according to one or more embodiments. The block diagram shows a software view of gaming network 100, including gaming machine 103, control center server 101, and other gaming servers which cooperate to provide gaming results and player accounting on the network 100. To simplify the drawing, only the relevant software modules are depicted, and, of course, many further software modules are present on an operating system.

As shown, gaming machine 103 includes game software 1201 which operates to present the game results to the player on the gaming machine, interact with the player through the various user interfaces, and communicate with game determinant control software 1216 and accounting control software 1218 on the various gaming servers in order to obtain gaming outcomes and account for the player's credit awards. Communication is achieved through the services provided by the operating system 1206 and network interface 1208 present on all of the depicted machines.

Also shown is the control center server 101, some of the functionality of which has been described in some detail above. Control center server 101 helps to manage the out-of-revenue functionality of the gaming machines 103 on the network 100 using tournament and out-of-revenue control software 1210, and in this embodiment provides further capabilities to manage and control the interactive features such as the Pop and Win feature described above using interactive feature control software 1212.

Referring to the interactive feature control software 1212, in this embodiment, control software 1212 provides an interface through which operators can add and manage interactive features to be presented as an additional or overlay feature during out-of-revenue tournament play, or in-revenue slot machine play. While the depicted interactive feature control software 1212 is shown as running on control center server 101, this is not limiting, and the depicted control software 1212 and promotional prize database 1214 may run on other machines such as a dedicated promotional control server or one of the other gaming servers. In some embodiments, the interactive feature control software also presents an external interface through which partners or advertising clients of the casino game operator may have controlled and secure access to certain features of the control center server to add data regarding their promotional prizes to the system. Typically, a game operator approval is needed before any third-party promotional data is added to an operational gaming network 100.

In operation, the interactive feature control software 1212 presents an interface allowing game operators to add promotional features and control the frequency with which they appear in a tournament or slot machine play. While, in preferred versions, the promotional prize database 1214 stores the data necessary to define the type of interactive feature in the prize and redemption method for each player interactive promotional feature, this is not limiting and some of this data may be stored in other places. For example, when promotional prizes are added to operational games, data descriptive of the prize and probability of its award may be added to paytables of certain games, or the electronic databases containing predetermined outcomes for the relevant games. To handle regulatory issues with modifying games that are currently operational, placeholder elements are preferably used in paytables and in predetermined outcome banks or databases, to provide operators with a game payout structure that has already been approved and will not be changed by merely changing the promotional prize. Other versions may not use any placeholder elements, but instead provide the interactive features and the related promotional prizes as extras, unrelated to the mathematics of the underlying base games which have been approved as fair by regulatory authorities. When a placeholder is used in an outcome bank or a prize table, the interactive feature control software 1212 provides operator capability to access the placeholder, whether it sits on the control center server 101 or another server such as one of the gaming servers, and replace a placeholder identifier with a prize identifier for the promotional price desire to be added. This step may also include changing the indicator of the prize value, changing an identifier indicating the type of interactive feature being used (i.e., popping balloon, moving character, etc.) and changing an indicator controlling whether the placeholder item is active in the game or not. When a placeholder is not used, the interactive feature control software 1212 allows the operator to insert items into the promotional prize database 1214, or base or secondary paytables of other operating games, by inserting a prize identifier, a prize value indicator, and interactive feature type indicator, and optionally other data which may link to a multimedia presentation associated with winning the prize or with conferring the prize to the player. When such a multimedia presentation link is included, the system 100 operates to present the multimedia presentation to the player at the designated time.

Through the interactive feature control software 1212, one or more prizes or a spectrum of prizes may be selected to be awarded through a pop-up interactive feature on a random EGM from a designated group of EGMs. A prize distribution (e.g. multiple prize levels and probability of occurrence) may be input to be applied to a designated group of EGMs. Further, one or more bonus or promotional prizes may be associated with a defined prize level, the prizes at one level may have an equal probability of occurring or may have different probabilities of occurrence. In one or more embodiments, a player may have the option to select from one or more prizes at a given prize level, when the pop-up is selected for the given prize level (e.g. select between dinner at a steakhouse or an overnight stay at the casino resort hotel).

In one or more embodiments, the interactive feature control software 1212 further provides the ability to set which gaming machines on the gaming floor and on one or more Tournevent banks are eligible to win any particular prize added to the system.

The interactive feature control software 1212 also provides the operator ability to remove promotional prizes from operation by recalling them out of any active tournament games or in-revenue games. This recall may be set automatically, after a given time period or number of tournaments. For example, if a car dealer was to offer a promotional prize on highroller slot machines giving away a certain number of cars, the interactive feature control software 1212 provides the operator ability to add cars into the system, and then if all of the cars were not given away within the desired time period for the promotion, the control software 1212 provides the operator ability to locate and remove those promotional items from the promotional prize database, or any paytables or predetermined outcome sets in which they have been deployed.

As noted above, prizes available in a tournament game or other game may be either a point amount, credit amount, or an alternative prize such as a physical object or a prize that may be redeemed at another location, such as a dinner for two. In the event that the prize is a credit amount, that amount may be added to the player's credit meter. In the event that the prize is a point total (such as points earned for a result in some types of tournaments), the amount may be added to the player's point total for that competition. In the event that the prize is a dinner or dinner for two or a physical object, the prize may be handled separately from the credit or point totals maintained for the player.

In one implementation, each participating gaming machine may have a balloon prize software module. This module is executable such that when the processor causes the primary touch sensitive display to show a balloon, if the player touches the area of the display associated with the balloon, then the game processor may cause a printer at the gaming machine to print a coupon with the pre-determined prize on it and likely an associated bar code that may be read by a redemption device, such as at a player cage or the given restaurant or by an accounting or redemption center coupon reader once the coupon is presented by a player for redemption at the given establishment. In the event that additional balloons and non-credit awards are provided to a player, then additional coupons may be printed.

In another implementation, when the processor causes the primary touch sensitive display to show a balloon, if the player touches the area of the display associated with the balloon, then the game processor may send a signal to a server (such as the tournament server) that the player has selected the balloon and won an associated prize. If the prize is a non-credit award or prize, then the server may record the award and print a coupon either at that time or following conclusion of an event (such as a tournament). The coupon may then be given to the player winning the award. Alternatively, a host at the tournament server may manually write a chit or coupon redeemable by the player at a given establishment (such as a restaurant).

In another alternative, the system may be completely automated such that the player is informed of an award, such as on the display and told to go to a given location to redeem the award (e.g. a particular steakhouse for dinner for two, a particular hotel check-in for free lodging, a specified spa for a free spa treatment, a specified gift shop for a $100 free purchase, etc.) In this case, the gaming machine or connected gaming server may send a message to the respective location with the name of the player or other identifying information such as a code provided to the player. The code may be printed by the gaming machine or gaming server, or, may simply be displayed for the player to record, or the code may be associated with a player's club card that may be presented to redeem the award and stored in association with the player's account on the player account server.

In another implementation, the gaming server, such as the tournament server, may include an operator keyboard and display for selecting prize ranges (values and associated probability spectrum—e.g. enter number of buffet tickets to be offered during a given period, number of spa tickets, number of show tickets, cash amount of credit awards and number of such awards) and types (e.g. credits, buffet, spa, show awards or prizes) to be potentially awarded or offered to players during either regular or tournament game play, in-revenue or out-of-revenue.

Although the alternate prize arrangement is described above in the context of the balloon interactive game, the same principles are applicable to other types of games.

Referring generally to the forgoing description, as used herein the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described example embodiments are intended to illustrate the principles of the invention, but not to limit the scope of the invention. Various other embodiments and modifications to these preferred embodiments may be made by those skilled in the art without departing from the scope of the present invention. The described embodiments illustrate the scope of the invention, but do not limit it.

The invention claimed is:

1. A method for providing a player interactive bonus feature in a tournament game, the method including:

activating the tournament game responsive to a player input at a player station;

determining a random or pseudo-random tournament game outcome for the activation of the tournament game;

displaying a tournament game presentation at the player station according to the determined tournament game outcome;

initiating the player interactive bonus feature responsive to a trigger;

displaying a player interactive feature graphic at the player station concurrently with at least part of the tournament game presentation at the player station according to the determined tournament game outcome;

determining a bonus award associated with the player interactive bonus feature, the bonus award being determined directly in response to a second player input associated with the player interactive feature graphic at the player station; and awarding the bonus award in the form of a non-credit prize.

2. The method of claim 1 wherein initiating the player interactive bonus feature is performed concurrently with displaying the tournament game presentation at the player station according to the determined tournament game outcome.

3. The method of claim 2 wherein the player interactive feature graphic is overlain over a portion of the tournament game presentation with the complete tournament game presentation remaining visible.

4. The method of claim 1 wherein the non-credit prize is redeemable with a coupon printed at the player station in response to the second player input causing the bonus award.

5. The method of claim 4, further comprising transmitting a code to a server accessible at an associated redemption location, the code allowing the player to redeem the non-credit prize at the redemption location.

6. The method of claim 1, further including awarding the bonus award to the player in addition to an award associated with the tournament game outcome.

7. The method of claim 1, further including awarding the bonus award to the player without modifying a tournament game score depending on the tournament game outcome.

8. The method of claim 1, wherein the bonus award is redeemable by the player at another location.

9. The method of claim 1, wherein the bonus award is a physical prize.

10. The method of claim 1 including receiving the trigger for the player interactive bonus feature at the player station from a tournament controller located remotely from the player station.

11. A system for providing a player interactive bonus feature in a tournament game, the system including:

a number of player stations, each player station including a player interface enabling a player for the player station to make a tournament activation input;

a tournament game result determination arrangement configured to determine a random or pseudo-random tournament game outcome for each tournament game activated at a respective player station;

a respective tournament game display included with each player station, each respective tournament game display configured to display a tournament game presentation according to a respective tournament game outcome determined for a respective tournament game activated at the respective player station;

a player interactive bonus feature triggering arrangement configured to initiate a player interactive bonus feature at one or more of the player stations during a tournament conducted through the player stations; and a bonus award determination arrangement configured to determine a bonus award for a respective player interactive bonus feature, the bonus award being directly determined in response to a second player input associated with a player interactive feature graphic at the player station; and a bonus award conferring arrangement configured to provide the bonus award to the player in the form of a non-credit prize.

12. The system of claim 11, wherein the bonus award is redeemable by the player at another location.

13. The system of claim 11, wherein the bonus award conferring arrangement is further configured for transmitting a code to a server accessible at an associated redemption location, the code allowing the player to redeem the non-credit prize at the redemption location.

14. The system of claim 11, wherein the bonus award is a physical prize.

15. The system of claim 11 including a tournament controller configured to administer the tournament conducted through the player stations.

16. The system of claim 15 wherein the tournament controller is configured to communicate the trigger for a respective player interactive bonus feature to the respective player station.

17. The system of claim 11 wherein the tournament game display at a respective player station displays the player interactive feature graphic concurrently with at least part of displaying a respective tournament game presentation at the respective player station.

18. The system of claim 11 wherein a bonus award associated with a respective player interactive bonus feature is determined responsive to a player interactive game input at the player station, and wherein a player interactive bonus score is modified without modifying the tournament game score based on the bonus award.

19. The system of claim 11 wherein the player interactive bonus triggering arrangement is configured to initiate a respective player interactive bonus feature at one or more of the player stations concurrently with the display of a tournament game presentation at the player stations.

20. A program product comprising program code stored on one or more tangible and non-transitory computer readable media, the program code including:

tournament game program code executable to activate a tournament game responsive to a player input at a player station, determine a random or pseudo-random tournament game outcome for the activation of the tournament game, cause a tournament game presentation to be displayed at the player station according to the determined tournament game outcome, and modify a tournament game score depending upon the tournament game outcome;

interactive bonus feature program code executable to initiate a player interactive bonus feature at the player station responsive to a trigger, and to cause an interactive bonus feature graphic to be displayed at the player station concurrently with the tournament game presentation;

a bonus award conferring arrangement code executable a bonus award for a respective player interaction bonus feature, the bonus award being directly determined in response to a second player input associated with the player interaction feature graphic at the player station; and a bonus award conferring arrangement code executable to provide the bonus award to the player in the form of a non-credit prize.

* * * * *